US005963238A

United States Patent [19]

Scheffelin et al.

[11] Patent Number: 5,963,238

[45] **Date of Patent: *Oct. 5, 1999**

[54] INTERMITTENT REFILLING OF PRINT CARTRIDGE INSTALLED IN AN INKJET PRINTER

[75] Inventors: Joseph E. Scheffelin; David S. Hunt, both of San Diego; Mark E. Young, Escondido; Elizabeth Zapata, San Diego; Alfred Zepeda, San Marcos; Christopher J. Schultz, San Diego; Jon Fong, Manhattan Beach, all of Calif.

[73] Assignee: Hewlett-Packard Company, Palo Alto, Calif.

[ * ] Notice: This patent is subject to a terminal disclaimer.

[21] Appl. No.: 09/073,168

[22] Filed: May 5, 1998

Related U.S. Application Data

[63] Continuation-in-part of application No. 08/322,848, Oct. 13, 1994, Pat. No. 5,621,445, application No. 08/503,756, Jul. 18, 1995, abandoned, and application No. 08/314,978, Sep. 29, 1994, abandoned, said application No. 08/322,848, is a continuation-in-part of application No. 08/171,321, Dec. 21, 1993, abandoned, which is a continuation of application No. 07/750,360, Aug. 27, 1991, Pat. No. 5,280,300, said application No. 08/503,756, is a continuation-in-part of application No. 07/717,735, Jun. 19, 1991, Pat. No. 5,359,353.

[51] Int. Cl.[6] ..... B41J 2/175

[52] U.S. Cl. ..... 347/85

[58] Field of Search ..... 347/7, 85, 86, 347/87

[56] References Cited

U.S. PATENT DOCUMENTS

| | | | |
|---|---|---|---|
| 743,798 | 11/1903 | Allwardt | 251/149.7 |
| 1,150,420 | 8/1915 | Davis et al. | 285/308 |
| 1,563,331 | 12/1925 | Bright | 62/308 |
| 1,850,879 | 3/1932 | Hunt | 251/149.9 |
| 2,327,611 | 8/1943 | Scheiwer | 285/316 |
| 2,412,685 | 12/1946 | Hoffman et al. | 251/149.6 |
| 2,612,389 | 9/1952 | MacGlashan, Jr. | 251/149.7 |
| 2,915,325 | 12/1959 | Foster | 285/276 |
| 3,140,912 | 7/1964 | Davis et al. | 346/140.1 |
| 3,223,117 | 12/1965 | Curie et al. | 137/556.6 |
| 3,230,964 | 1/1966 | Debrotnic | 251/149.5 |
| 3,339,883 | 9/1967 | Drake | 251/149.4 |
| 3,430,824 | 3/1969 | Conners et al. | 222/523 |
| 3,493,146 | 2/1970 | Conners et al. | 222/153.06 |
| 3,614,940 | 10/1971 | Abrams et al. | 118/710 |
| 3,777,771 | 12/1973 | De Visscher | 137/1 |
| 3,787,882 | 1/1974 | Fillmore et al. | 347/6 |

(List continued on next page.)

FOREIGN PATENT DOCUMENTS

| | | | |
|---|---|---|---|
| 0604712A1 | 7/1994 | European Pat. Off. | B29C 45/16 |
| 59-204569 | 11/1984 | Japan . | |
| 58-81147 | 4/1985 | Japan | B41J 3/04 |

*Primary Examiner*—N. Le
*Assistant Examiner*—Anh T. N. Vo

[57] ABSTRACT

A print cartridge is described which has an ink recharge port and valve structure to enable the print cartridge reservoir to be recharged with ink. A slideable, generally cylindrical ink valve extends through the print cartridge body and into the ink bag. The valve has a male connector portion at its end external to the print cartridge body. The valve is open when pushed into the print cartridge body and closed when pulled away from the print cartridge body. An ink refill system containing a supply of ink has a slideable valve with a female connector portion which is engageable with the male connector portion of the print cartridge valve. To recharge the print cartridge ink reservoir, the end of the print cartridge valve is inserted into the end of the ink refill system valve to create both a mechanical coupling and a fluid tight coupling between the two valves. A further force pushing the print cartridge against the ink refill system causes both valves to be pushed inside their respective ink reservoirs. This further insertion causes both valves to become open, thus creating an airtight fluid path between the ink refill system reservoir and the depleted print cartridge reservoir. When the valves are mechanically decoupled, the valves are automatically closed.

19 Claims, 26 Drawing Sheets

U.S. PATENT DOCUMENTS

| | | | |
|---|---|---|---|
| 3,873,062 | 3/1975 | Johnson et al. | 251/149.6 |
| 3,896,853 | 7/1975 | Bernhard | 137/614.05 |
| 4,183,031 | 1/1980 | Kyser et al. | 347/8.6 |
| 4,234,885 | 11/1980 | Arway | 347/85 |
| 4,412,232 | 10/1983 | Weber et al. | 347/68 |
| 4,422,084 | 12/1983 | Saito | 347/7 |
| 4,475,116 | 10/1984 | Sicking et al. | 347/86 |
| 4,496,959 | 1/1985 | Frerichs | 347/86 |
| 4,500,895 | 2/1985 | Buck et al. | 347/87 |
| 4,558,326 | 12/1985 | Kimura et al. | 347/30 |
| 4,590,494 | 5/1986 | Ichihashi et al. | 347/43 |
| 4,591,875 | 5/1986 | McCann | 347/86 |
| 4,673,955 | 6/1987 | Ameyama et al. | 347/86 |
| 4,677,447 | 6/1987 | Nielsen | 347/87 |
| 4,680,696 | 7/1987 | Ebinuma et al. | 347/85 |
| 4,689,642 | 8/1987 | Sugitani | 347/87 |
| 4,700,205 | 10/1987 | Rich et al. | 347/6 |
| 4,703,332 | 10/1987 | Crotti et al. | 347/87 |
| 4,714,937 | 12/1987 | Kaplinsky | 347/86 |
| 4,777,497 | 10/1988 | Nozu et al. | 347/68 |
| 4,940,997 | 7/1990 | Hamlin et al. | 347/87 |
| 4,959,667 | 9/1990 | Kaplinsky | 347/87 |
| 4,967,207 | 10/1990 | Ruder | 347/7 |
| 4,968,998 | 11/1990 | Allen | 347/7 |
| 4,973,993 | 11/1990 | Allen | 347/7 |
| 4,992,802 | 2/1991 | Dion et al. | 347/87 |
| 4,999,652 | 3/1991 | Chan | 347/86 |
| 5,008,688 | 4/1991 | Ebinuma et al. | 347/86 |
| 5,103,243 | 4/1992 | Cowger | 347/87 |
| 5,126,767 | 6/1992 | Asai | 347/86 |
| 5,270,739 | 12/1993 | Kitani et al. | 347/87 |
| 5,280,300 | 1/1994 | Fong et al. | 347/87 |
| 5,283,593 | 2/1994 | Wehl | 347/86 |
| 5,343,226 | 8/1994 | Niedermeyeyr et al. | 347/85 |
| 5,365,262 | 11/1994 | Hattori et al. | 347/87 |
| 5,367,328 | 11/1994 | Erickson | 347/7 |
| 5,369,429 | 11/1994 | Erickson | 347/7 |
| 5,425,478 | 6/1995 | Kotaki et al. | 222/501 |
| 5,650,811 | 7/1997 | Seccombe et al. | 347/85 |
| 5,748,216 | 5/1998 | Scheffelin et al. | 347/87 |
| 5,777,648 | 7/1998 | Scheffelin et al. | 347/87 |
| 5,852,458 | 12/1998 | Scheffelin et al. | 347/86 |

INTERMITTENT REFILLING OF PRINT CARTRIDGE INSTALLED IN AN INKJET PRINTER

CROSS-REFERENCE TO RELATED APPLICATIONS

This application is a continuation-in-part of U.S. application Ser. No. 08/322,848, filed Oct. 13, 1994, now U.S. Pat. No. 5,621,445 entitled Apparatus for Refilling Ink Cartridges, by Jon Fong et al., HP Docket No. 1094441-1, which is a continuation-in-part of U.S. application Ser. No. 08/171,321 filed Dec. 21, 1993, now abandoned, which is a continuation of U.S. application Ser. No. 07/750,360, now U.S. Pat. No. 5,280,300 filed Aug. 27, 1991.

This application is also a continuation-in-part of U.S. application Ser. No. 08/503,756, filed Jul. 18, 1995, entitled Ink Cartridge With Passageway for Ink Level Indica David Hunt, HP Docket No. 1093054-1, now abandoned, which is a continuation-in-part of U.S. application Ser. No. 07/717, 735, filed Jun. 19, 1991, now U,S. Pat. No. 5,359,353 entitled Spring-Bag Printer Ink Cartridge With Volume Indicator, by David Hunt.

This application is also continuation-in-part of U.S. application Ser. No. 08/314,978, filed Sep. 29, 1994, entitled Method and Apparatus for Regulating Replenishment Ink Flow to a Print Cartridge by Joseph Scheffelin, HP Docket No. 1094163-1, now abandoned. All the above applications are incorporated herein by reference.

FIELD OF THE INVENTION

This invention relates to inkjet printers and, more particularly, to an inkjet print cartridge which can be recharged with ink.

BACKGROUND OF THE INVENTION

A popular type of inkjet printer contains a scanning carriage for supporting one or more disposable print cartridges. Each disposable print cartridge contains a supply of ink in an ink reservoir, a printhead, and ink channels which lead from the ink reservoir to ink ejection chambers formed on the printhead. An ink ejection element, such as a heater resistor or a piezoelectric element, is located within each ink ejection chamber. The ink ejection elements are selectively fired, causing a droplet of ink to be ejected through a nozzle overlying each activated ink ejection chamber so as to print a pattern of dots on the medium. When such printing takes place at 300 dots per inch (dpi) or greater, the individual dots are indistinguishable from one another and high quality characters and images are printed.

Once the initial supply of ink in the ink reservoir is depleted, the print cartridge is disposed of and a new print cartridge is inserted in its place. The printhead, however, has a usable life which outlasts the ink supply. Methods have been proposed to refill these single-use-only print cartridges, but such refilling techniques require penetration into the print cartridge body in a manner not intended by the manufacturer and typically require the user to manually inject the ink into the print cartridge. Additionally, the quality of the refill ink is usually lower than the quality of the original ink. As a result, such refilling frequently results in ink drooling from the nozzles, a messy transfer of ink from the refill kit to the print cartridge reservoir, air pockets forming in the ink channels, poor quality printing resulting from the ink being incompatible with the high speed printing system, and an overall reduction in quality of the printed image.

What is needed is an improved structure and method for recharging the ink supply in an inkjet print cartridge which is not subject to any of the above-mentioned drawbacks of the existing systems.

SUMMARY

An ink printing system is described herein which includes an inkjet printer, a removable print cartridge having an ink reservoir, an initial fill port, and a refill valve, and an ink refill system for engaging the print cartridge's refill valve and transferring ink to the ink reservoir.

In a preferred embodiment, the ink reservoir in the print cartridge consists of a spring-loaded collapsible ink bag, where the spring urges the sides of the ink bag apart and thus maintains a negative pressure within the ink bag relative to ambient pressure. As the ink is depleted during use of the print cartridge, the ink bag progressively collapses and overcomes the spring force.

A slideable, generally cylindrical ink valve extends through the print cartridge body and into the ink bag. The valve has a male connector portion at its end external to the print cartridge body. The valve is open when pushed into the print cartridge body and closed when pulled away from the print cartridge body.

An ink refill system containing a supply of ink has a slideable valve with a female connector portion which is engageable with the male connector portion of the print cartridge valve. The ink refill system valve extends through the ink refill system body and into the ink supply.

To recharge the print cartridge ink reservoir, the end of the print cartridge valve is inserted into the end of the ink refill system valve to create both a mechanical coupling and a fluid tight coupling between the two valves. A further force pushing the print cartridge against the ink refill system causes both valves to be pushed inside their respective ink reservoirs. This further insertion causes both valves to become open, thus creating an airtight fluid path between the ink refill system reservoir and the depleted print cartridge reservoir.

The force used to engage the two valves also engages a support member on the ink refill system with a support member on the print cartridge to support the print cartridge in an optimum position over the ink refill system. In a preferred embodiment, the support member is a cylindrical sleeve surrounding each valve.

The negative pressure within the print cartridge ink bag draws the ink from the ink refill system reservoir into the ink bag until the ink bag is substantially full. The print cartridge is then removed from the ink refill system. The mechanical coupling initially created between the two valves acts to pull the two valves closed as the print cartridge is pulled from the ink refill system. Once the two valves are closed, further pulling of the print cartridge releases the mechanical coupling, and the print cartridge may now be reused.

In a preferred embodiment, the ink refill system contains one recharge for the print cartridge.

DETAILED DESCRIPTION OF THE PREFERRED EMBODIMENTS

Figure 1:
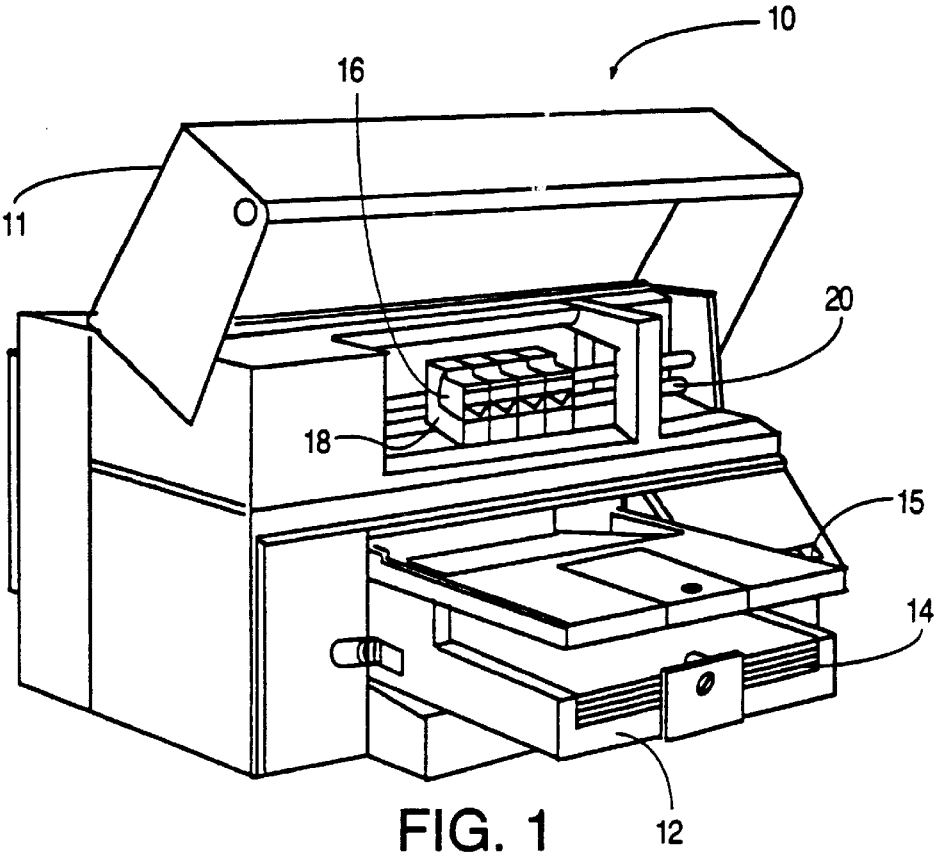
FIG. 1 is a perspective view of an inkjet printer incorporating the preferred embodiment inkjet print cartridge.

FIG. 1 illustrates an inkjet printer 10 incorporating the preferred embodiment rechargeable print cartridge. Inkjet printer 10 itself may be conventional. A cover 11 protects the printing mechanism from dust and other foreign objects. A paper input tray 12 supports a stack of paper 14 for printing thereon. The paper, after printing, is then deposited in an output tray 15.

Description of Print Cartridge 16

In the embodiment shown in FIG. 1, four print cartridges 16 are mounted in a scanning carriage 18. Print cartridges 16 contain black, cyan, magenta, and yellow ink, respectively. Selective activation of the ink firing elements in each of the four print cartridges 16 can produce a high resolution image in a wide variety of colors. In one embodiment, the black inkjet print cartridge 16 prints at 600 dots per inch (dpi), and the color print cartridges 16 print at 300 dpi.

The scanning carriage 18 is slideably mounted on a rod 20, and carriage 18 is mechanically scanned across the paper, using a well-known belt/wire and pulley system, while print cartridges 16 eject droplets of ink to form printed characters or other images. Since the mechanisms and electronics within printer 10 may be conventional, printer 10 will not be further described in detail.

Figure 2:
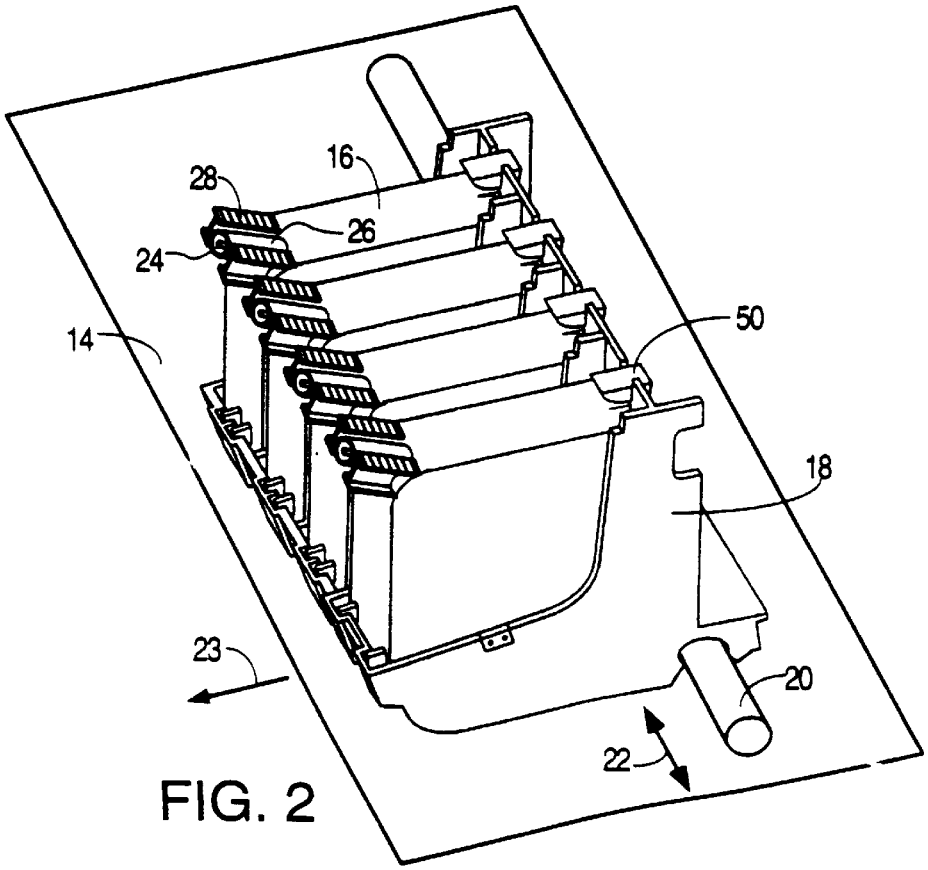
FIG. 2 is a perspective view of the preferred embodiment print cartridge being supported by a scanning carriage in the printer of FIG. 1.

FIG. 2 is a more detailed view of the scanning carriage 18 housing print cartridges 16. Carriage 18 moves in the direction indicated by arrow 22, and a sheet of paper 14 moves in the direction of arrow 23 perpendicular to the direction of movement of carriage 18.

Each print cartridge 16 is removable and engages with fixed electrodes on carriage 18 to provide the electrical signals to the printheads within each of print cartridges 16.

Each of print cartridges 16 contains a valve 24 which may be opened and closed. In an open state, ink from an external ink supply may flow through valve 24 and into the ink reservoir within print cartridge 16. Valve 24 is surrounded by a cylindrical plastic sleeve 26, which generally forms part of a handle 28 for allowing the user to easily grasp print cartridge 16 for insertion into and removal from carriage 18.

Additional detail regarding carriage 18 is found in U.S. Pat. No. 5,408,746, entitled "Datum Formation for Improved Alignment of Multiple Nozzle Members in a Printer," by Jeffrey Thoman, et al., assigned to the present assignee and incorporated herein by reference.

Figure 3:
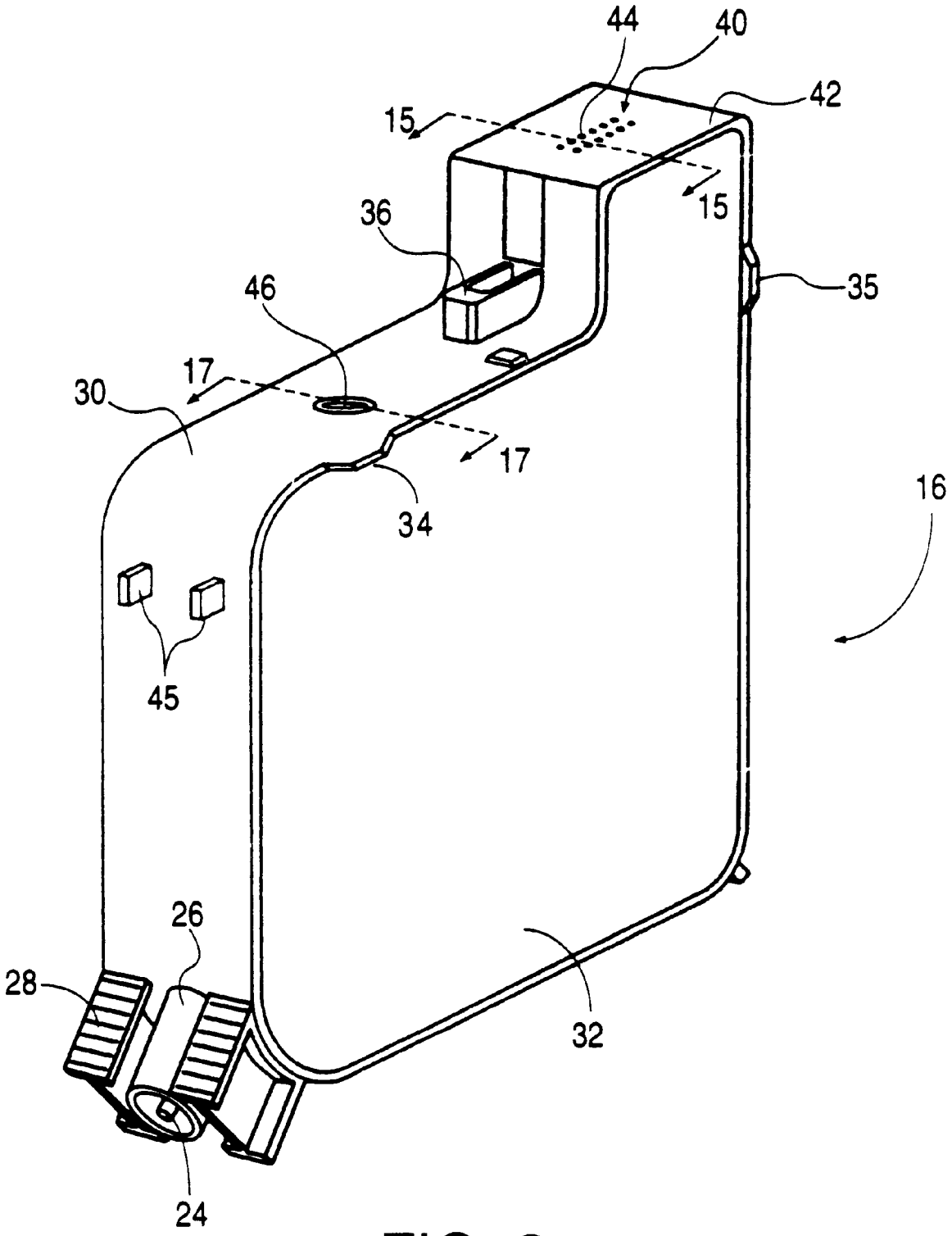
FIG. 3 is a perspective view of the preferred embodiment print cartridge incorporating a refill valve.

FIG. 3 shows one perspective view of the preferred embodiment print cartridge 16. Elements labeled with the same numerals in other figures are identical. The outer frame 30 of print cartridge 16 is formed of molded engineering plastic, such as the material marketed under the trademark "NORYL" by General Electric Company. Side covers 32 may be formed of metal or plastic. Datums 34, 35, and 36 affect the position of print cartridge 16 when installed in carriage 18. Datums 34, 35, and 36 are machined after the nozzle member 40 has been installed on a print cartridge 16 to ensure that all four print cartridges 16 have their respective nozzles aligned with each other when inserted into carriage 18. Additional detail regarding the formation of datums 34, 35, and 36 can be found in U.S. Pat. No. 5,408,746, entitled "Datum Formation for Improved Alignment of Multiple Nozzle Members in a Printer," previously mentioned.

In the preferred embodiment, nozzle member 40 consists of a strip of flexible tape 42 having nozzles 44 formed in the tape 42 using laser ablation. One method for forming such nozzles 44 is described in U.S. Pat. No. 5,305,015, entitled "Laser Ablated Nozzle Member for Inkjet Printhead," by Christopher Schantz et al., assigned to the present assignee and incorporated herein by reference. The structure of this nozzle member 40 will be described in greater detail later.

Plastic tabs 45 are used to prevent a particular print cartridge 16 from being inserted into the wrong slot in carriage 18. Tabs 45 are different for the black, cyan, magenta, and yellow print cartridges.

A fill hole 46 is provided for initially filling the ink reservoir in print cartridge 16 by the manufacturer. This hole 46 is later sealed with a steel ball, which is intended to be permanent. Such filling will be described later.

Figure 4:
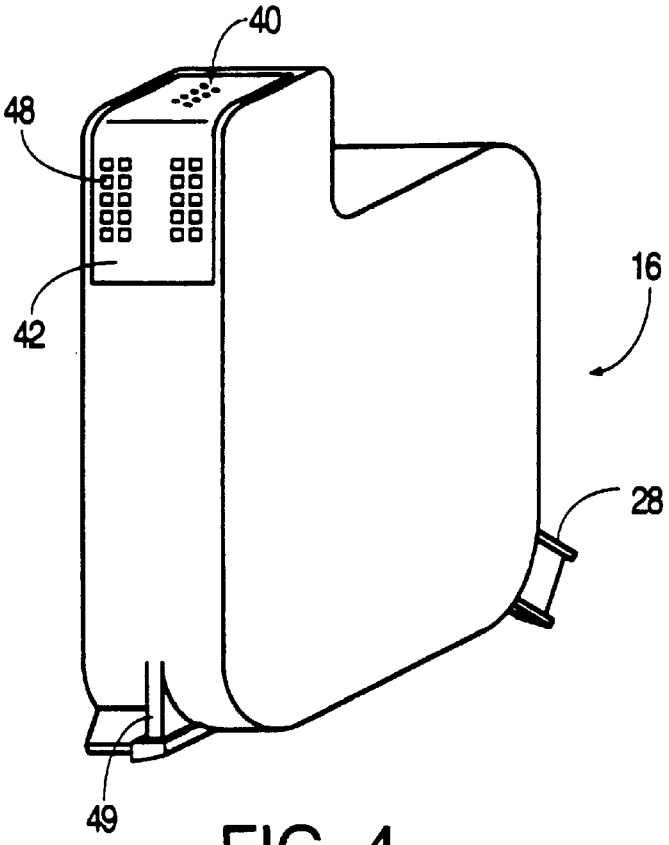
FIG. 4 is a different perspective view of the print cartridge of FIG. 3.

FIG. 4 is another perspective view of print cartridge 16 showing electrical contact pads 48 formed on the flexible tape 42 and connected via traces, formed on the underside of tape 42, to electrodes on the printhead substrate affixed to the underside of tape 42.

A tab 49 engages a spring-loaded lever 50 (FIG. 2) on carriage 18 for locking print cartridges 16 in place in carriage 18.

Figure 5:
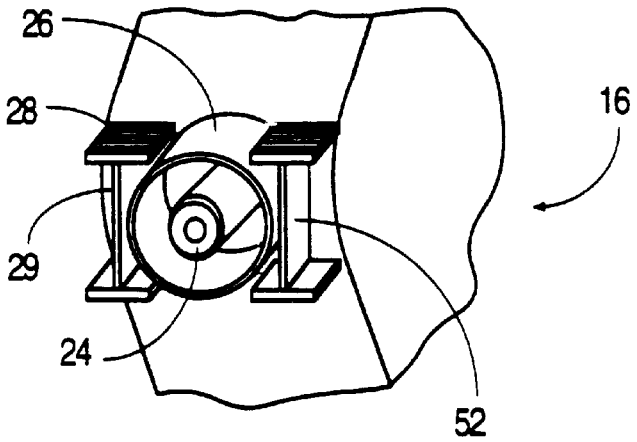
FIG. 5 is a close-up view of the refill valve on the print cartridge of FIG. 3.

FIG. 5 is a close-up of the print cartridge valve 24 surrounded by the cylindrical sleeve 26, forming part of handle 28. Support flanges 52 provide added support for handle 28.

Figure 6:
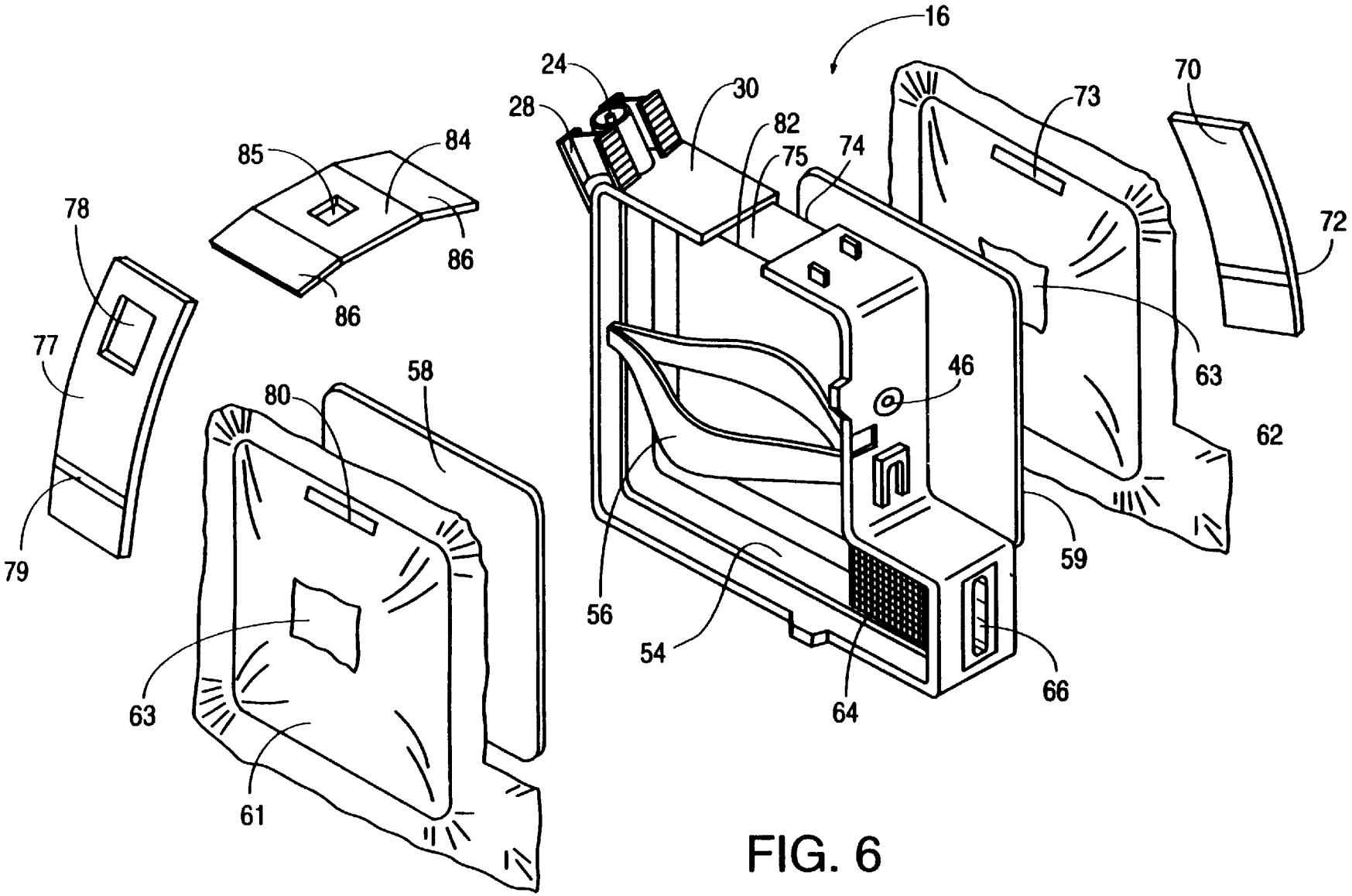
FIG. 6 is an exploded view of the print cartridge of FIG. 3 without side covers.

FIG. 6 is an exploded view of print cartridge 16 of FIG. 3 without side covers 32. FIG. 6 shows the construction of the collapsible ink bag 51, shown assembled in FIG. 7, which provides a negative internal pressure relative to atmospheric pressure. The construction of ink bag 51 is as follows.

A plastic inner frame 54 is provided which generally has the same contours as the rigid outer frame 30. Inner frame 54 is preferably formed of a plastic which is more flexible than that used to form outer frame 30 and has a lower melting temperature. A suitable plastic material is a soft polyolefin alloy. In the preferred embodiment, outer frame 30 is used as a portion of the mold when forming inner frame 54. Additional detail regarding the formation of frame 30 and frame 54 is found in U.S. application Ser. No. 07/994,807, filed Dec. 22, 1992, entitled "Two Material Frame Having Dissimilar Properties for a Thermal Ink-Jet Cartridge," by David Swanson, assigned to the present assignee and incorporated herein by reference.

A bow spring 56 is provided, which may be cut from a strip of metal such as stainless steel. The apexes of the bight portions of bow spring 56 are spot welded or laser welded to a central portion of rigid metal side plates 58 and 59. A pair of flexible ink bag sidewalls 61 and 62, formed of a plastic such as ethylene vinyl acetate (EVA) or Mylar, have their peripheral portions heat welded to the edges of inner frame 54 to provide a fluid seal and have their central portions 63 heat welded to side plates 58 and 59. The preferred sidewalls 61 and 62 are formed of a flexible nine-layer material described in U.S. Pat. No. 5,450,112, incorporated herein by reference.

The ink bag sidewalls 61 and 62 now oppose side plates 58 and 59 so as to pretension bow spring 56. Bow spring 56 now acts as a pressure regulator to provide a relatively constant outward force on the ink bag sidewalls 61 and 62 to provide a negative pressure on the order of −0.1 psi within ink bag 51 (equivalent to a relative pressure of about −3 inches of water). An acceptable negative pressure is in the range of approximately −1 to −7 inches of water, with the preferred range being −3 to −5 inches of water.

The actual negative pressure required of ink bag 51 is based on various factors, including the nozzle orifice architecture, the geometry of print cartridge 16 (including the outer expansion limits of ink bag 51 as determined by the thickness of print cartridge 16), and the horizontal/vertical orientation of print cartridge 16 when mounted in a printing position in carriage 18.

As ink is withdrawn from print cartridge 16, ink bag 51 (FIG. 7) will collapse.

An edge guard may optionally be bonded to the surface of metal side plates 58 and 59 to prevent the metal edges of plates 58 and 59 from contacting and tearing the ink bag sidewalls 61 and 62. This edge guard may be a thin plastic cover layer adhesively secured to the outer face of side plates 58 and 59 and slightly overlapping the edges.

A mesh filter 64 is also provided on inner frame 54 within ink bag 51 to filter out particles prior to the ink reaching the primary ink channel 66 formed in the snout portion of outer frame 30. A printhead assembly will later be secured to the snout portion of print cartridge 16, and ink channels in the printhead assembly will lead from the primary ink channel 66 into ink ejection chambers on the printhead.

Figure 7:
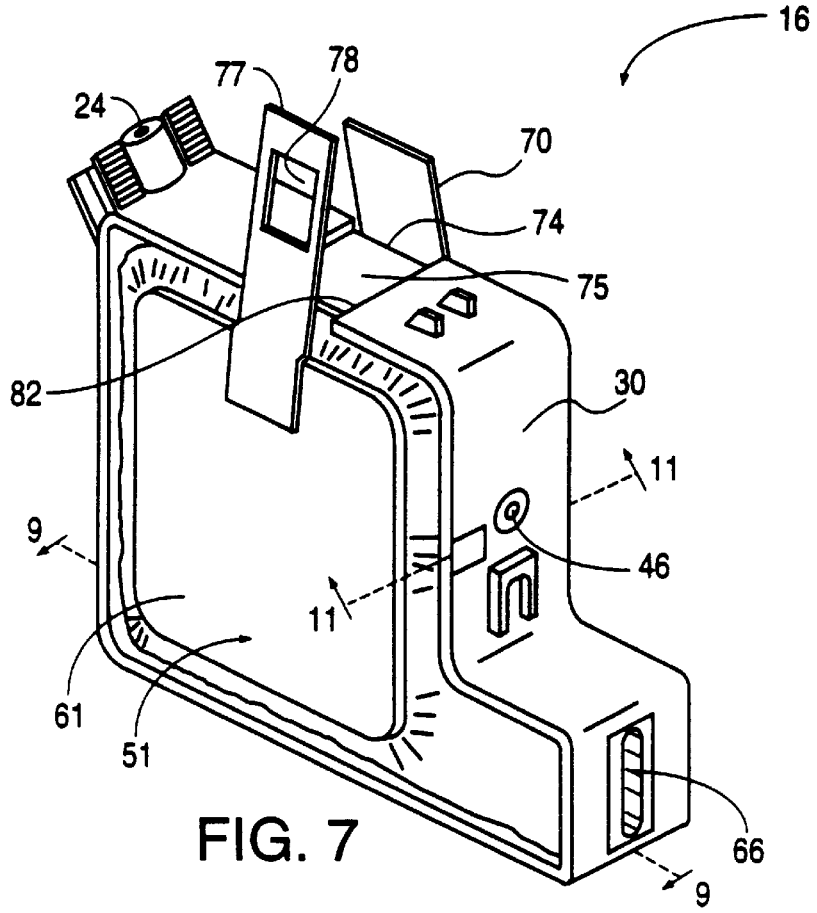
FIG. 7 is a perspective view of the print cartridge of FIG. 6 after assembly and prior to side covers being connected.

Ink bag 51 also includes a slideable valve 24, to be discussed in detail later. Ink bag 51 is thus now completely sealed except for the opening for the primary ink channel 66. FIG. 7 shows the structure of FIG. 6 prior to side covers being placed on print cartridge 16.

In the preferred embodiment, the amount of ink remaining in ink bag 51 is ascertained by means of an ink level detector, illustrated in FIGS. 6 and 7, formed as follows. A first paper strip 70 of a solid color, such as green, is secured to ink bag sidewall 62 via an adhesive 72 connected to area 73 on sidewall 62. The end of this strip 70 is then bent over the recessed edge 74 of frame 30 and lies flat against recessed surface 75 of frame 30. A strip 77 of a different color, such as black, is provided with a window 78. An adhesive 79 on strip 77 is then secured to sidewall 61 at area 80. Strip 77 is bent over the recessed edge 82 of frame 30 and now overlies solid strip 70 on the recessed surface 75. Once the side plates 32 (FIG. 3) are secured to print cartridge 16, a strip 84 having a transparent window 85, which may be a hole or a clear portion, is then secured over the recessed surface 75 by adhesively securing edges 86 to the respective side covers 32 on print cartridge 16. As the flexible ink bag sidewalls 61 and 62 become closer together as ink is depleted from the ink bag 51, the window 78 in strip 77 will expose less and less of the color of strip 70, as seen through window 85, until the green color of strip 70 is no longer exposed through window 85 and only the black strip 77 appears through window 85. Print cartridge 16 must then be recharged using valve 24 in the method described later.

Figure 8:
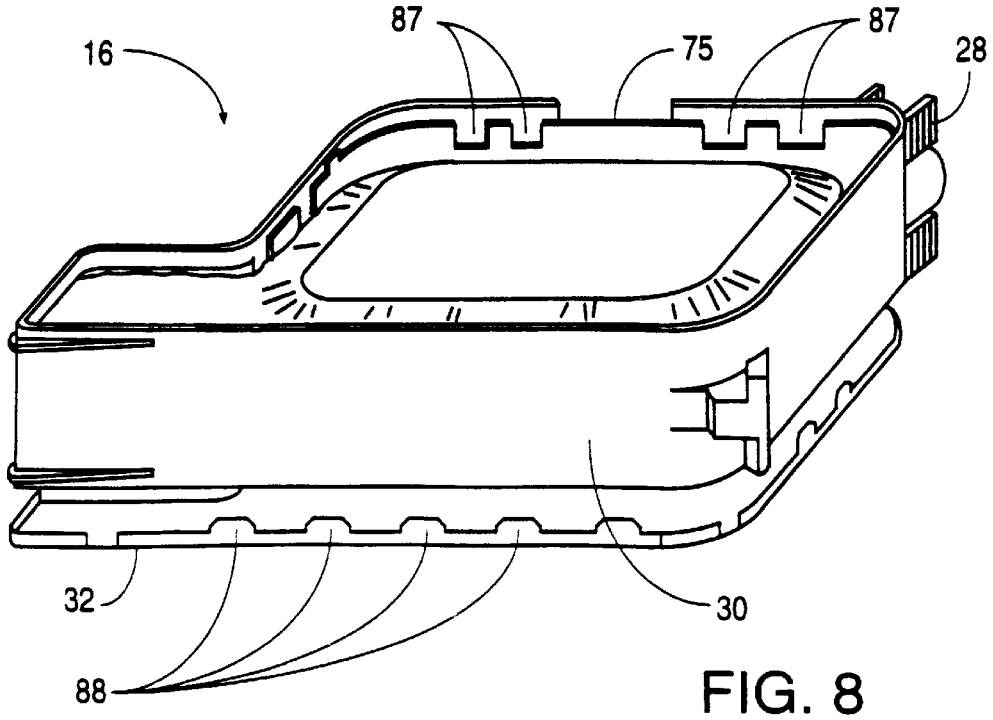
FIG. 8 is a perspective view of the print cartridge of FIG. 7 showing a side cover being connected.

FIG. 8 illustrates in greater detail one rigid side cover 32 and its method of being secured to the print cartridge outer frame 30. Slots 87 are shown formed in outer frame 30 which align with tabs 88 formed in side covers 32. Tabs 88, when inserted into slots 87, provide secure placement of the side covers 32 on frame 30. Preferably, tabs 88 slightly cut into the plastic forming the sides of slots 87 to form a high friction attachment of the side covers 32 to frame 30. Optionally, an adhesive may also be used to secure side covers 32 to frame 30.

Figure 9:
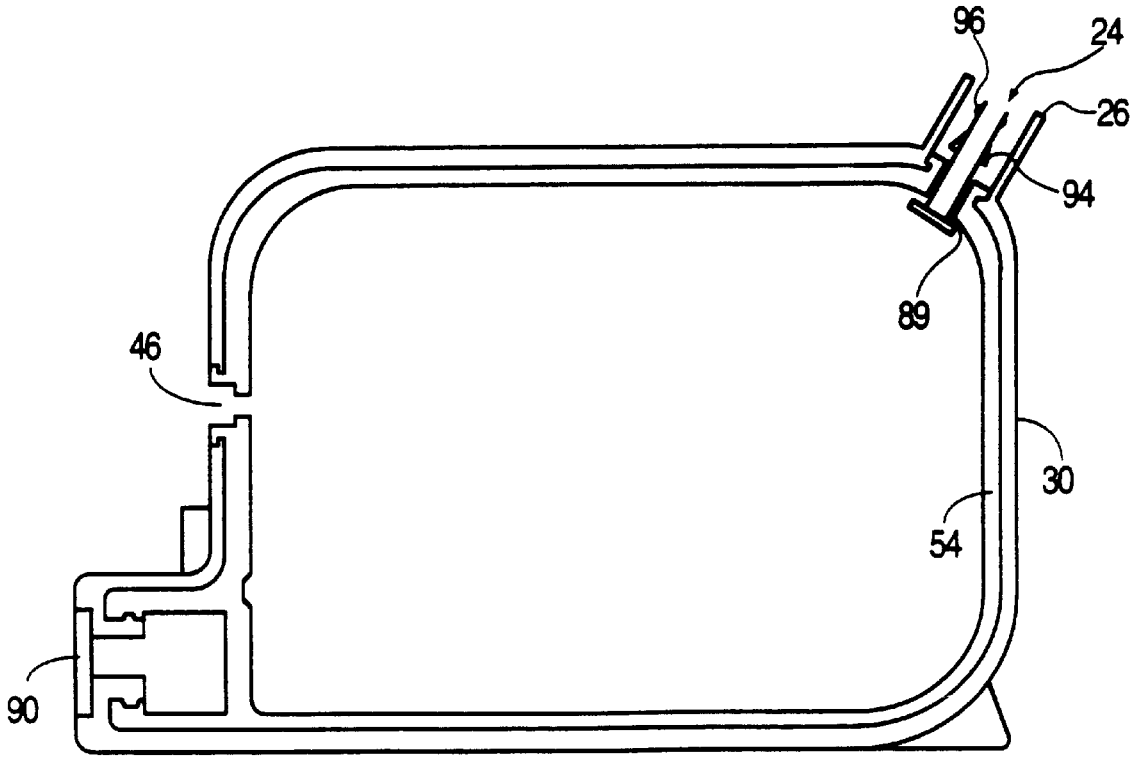
FIG. 9 is a cross-sectional view of the print cartridge of FIG. 7 taken along line 9—9 in FIG. 7.

FIG. 9 is a cross-sectional view of the outer frame 30 and inner frame 54 portion of print cartridge 16 along line 9—9 in FIG. 7, essentially bisecting the print cartridge 16. Valve 24 is shown in its closed position along with a cross-section of the cylindrical sleeve 26. Upon injection molding inner frame 54 using outer frame 30 as a partial mold, a fluid tight valve seal 89 is formed through which slideable valve 24 is inserted. Valve 24 may be formed of low density polyethylene (LDPE), Teflon™, or other suitable material. Also shown in the cross-section of FIG. 9 is ink fill port 46. A simplified portion of a printhead substrate 90 is also shown.

Figure 10A:
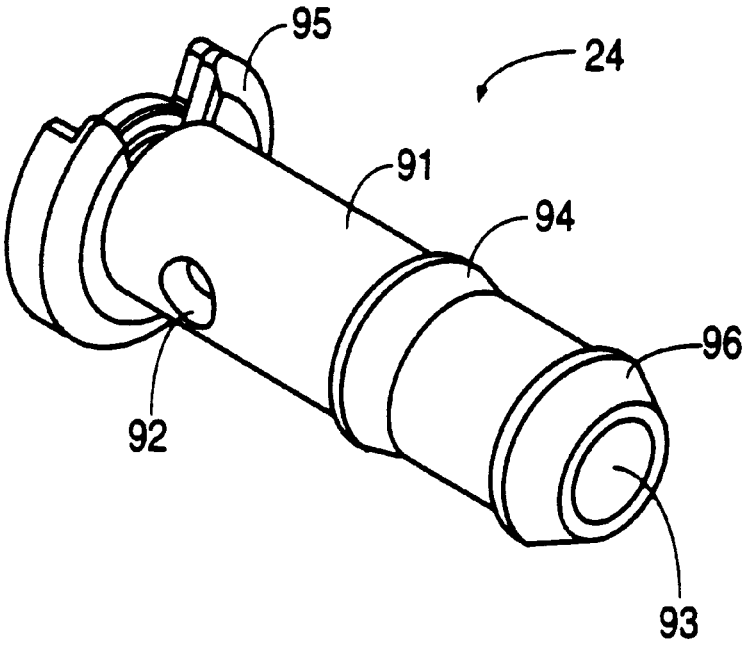
FIGS. 10A and 10B are perspective views of the slideable value used in the print cartridge of FIG. 7.
Figure 10B:
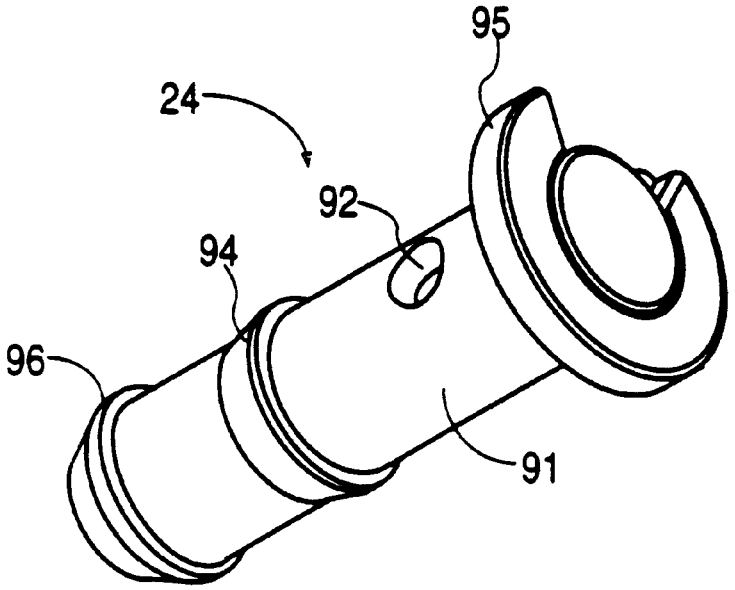

Additional detail of valve 24 is shown in FIGS. 10A and 10B. In the preferred embodiment, valve 24 consists of a hollow shaft portion 91 having a hole 92 formed in the side of shaft portion 91 and an opening 93 in the top of shaft portion 91. A first rib 94 limits the downward travel of valve 24 into the print cartridge body. A clip 95 is resiliently secured to the end of shaft portion 91 around an annular notch formed in shaft portion 91 to limit the upward travel of valve 24 out of the print cartridge body. Clip 95 may be formed of high density polyethylene (HDPE), polycarbonate, or other suitable material. An annular rib 96 is formed near the top of valve 24 which seats within a recess in a valve (to be described later) in an axillary ink reservoir. In the preferred embodiment, the length of valve 24 is 0.582 inches; however, an acceptable range may be approximately 0.25 to 1.0 inch depending on design factors such as ergonomics and reliability. The outer diameter of valve 24 is approximately 0.154 inches, but can be virtually any diameter.

Figure 11:
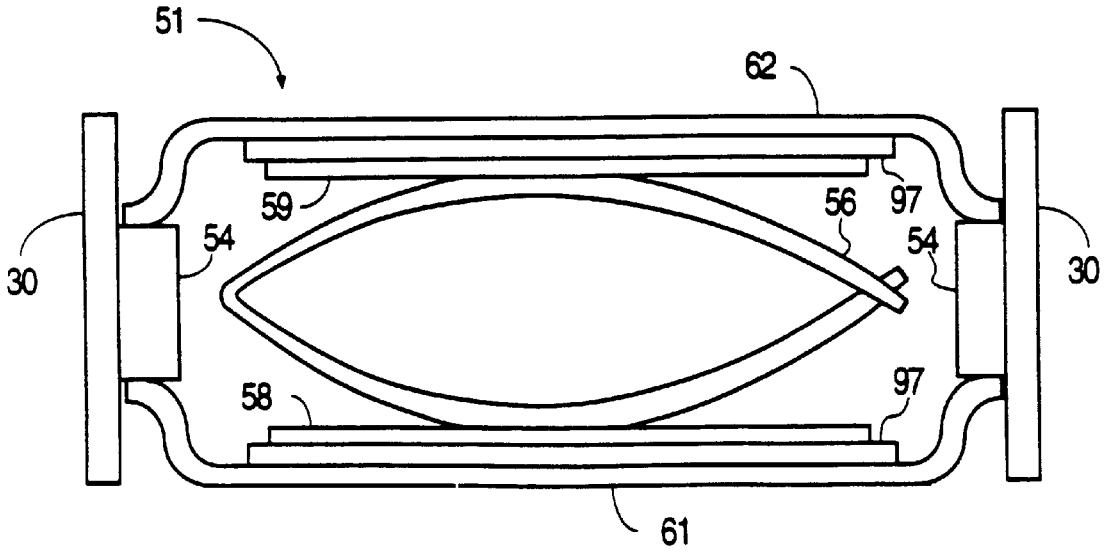
FIG. 11 is a cross-sectional view of the print cartridge of FIG. 7 taken along line 11—11 in FIG. 7.

FIG. 11 is a cross-sectional view of the structure of FIG. 7 taken along line 11—11 showing bow spring 56, flexible ink bag sidewalls 61 and 62, metal side plates 58 and 59, and optional protective edge guards 97. Spring 56 is pretensioned so that the spring force remains fairly constant as ink bag 51 collapses.

Additional information regarding the construction of the spring-loaded ink bag can be found in U.S. application Ser. No. 08/454,975, filed May 31, 1995, entitled "Continuous Refill of Spring Bag Reservoir in an Ink-Jet Swath Printer/Plotter," by Joseph Scheffelin et al., HP Case No. 10950576-1, assigned to the present assignee and incorporated herein by reference.

Other suitable negative pressure ink reservoirs include a plastic bellows, an ink bag have an external spring, a reservoir having an external pressure regulator, and a rigid reservoir whose internal pressure is regulated by a bubble source.

Figure 12:
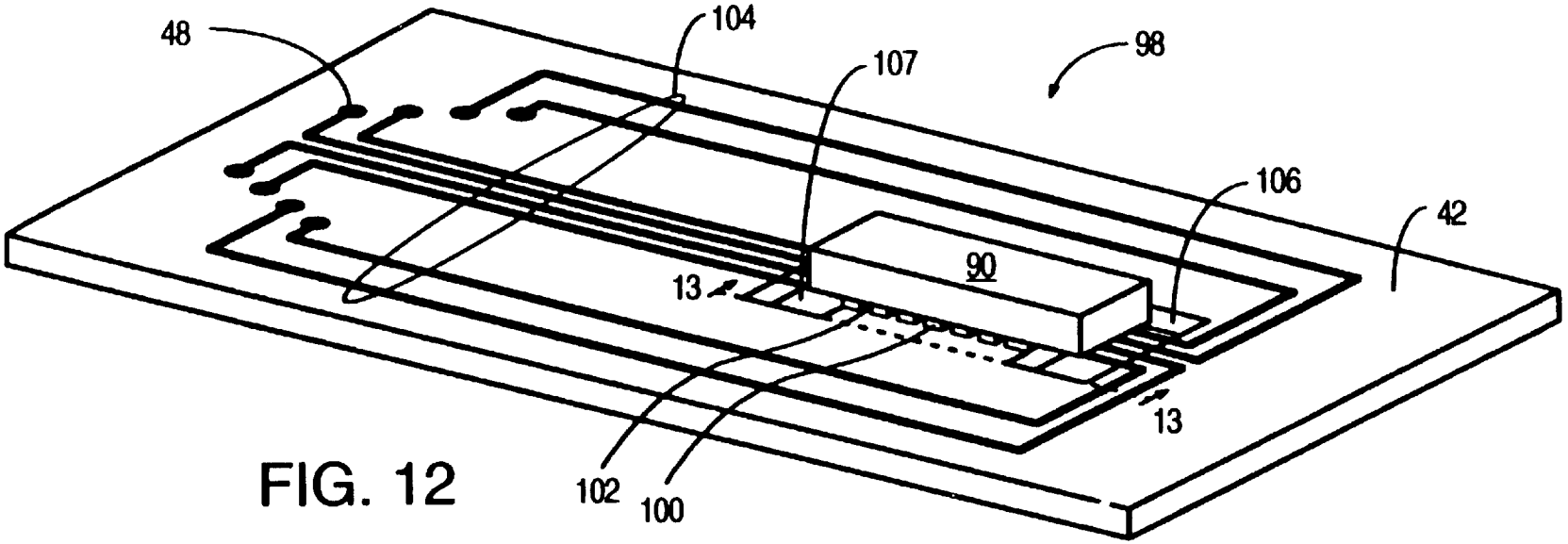
FIG. 12 is a perspective view of the back of a printhead assembly containing a printhead substrate mounted on a flexible tape and ink ejection nozzles formed in the tape, where electrodes on the substrate are bonded to conductive traces formed on the tape.

The printhead assembly will now be described. FIG. 12 shows a back surface of the printhead assembly 98 showing a silicon substrate 90 mounted to the back of a flexible tape 42. Printhead assembly 98 is ultimately affixed to the print cartridge 16 body as shown in FIG. 4 by heat staking. Tape 42 may be formed of a polyimide or other plastic. One edge of a barrier layer 100 formed on substrate 90 is shown containing ink channels 102 and ink ejection chambers, to be described later. The ink ejection chambers may also be referred to as vaporization chambers if the printhead is a thermal type.

Conductive traces 104 are formed on the back of tape 42 using a conventional photolithographic or plating process, where traces 104 terminate in contact pads 48, previously mentioned with respect to FIG. 4. The other ends of traces 104 connect to electrodes 108 (FIG. 13) on substrate 90. Windows 106 and 107 formed in tape 42 are used to gain access to the ends of traces 104 to bond these ends to the electrodes 108 on substrate 90.

Figure 13:
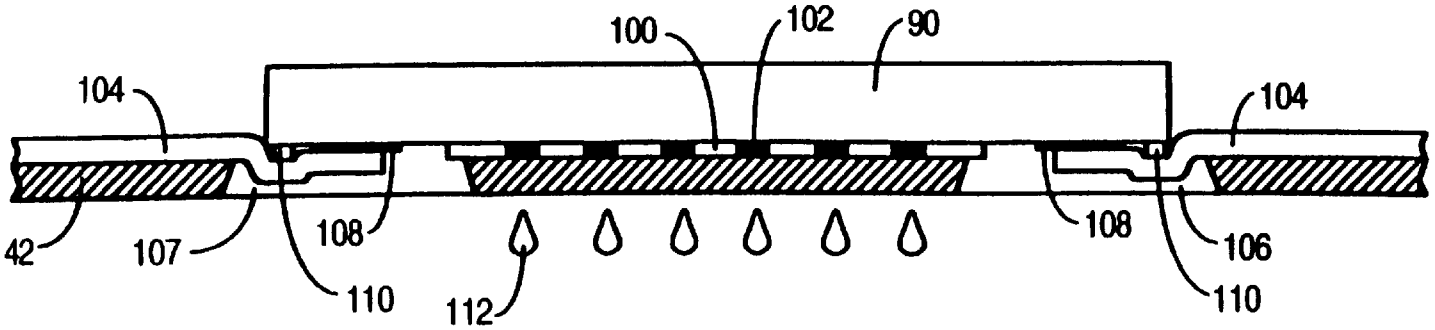
FIG. 13 is a cross-sectional view of the structure of FIG. 12 taken along line 13—13 in FIG. 12.

FIG. 13 shows a side view cross-section taken along line 13—13 in FIG. 12 illustrating the connection of the ends of the conductive traces 104 to electrodes 108 on substrate 90. As seen in FIG. 13, a portion 110 of barrier layer 100 is used to insulate the ends of the conductive traces 104 from substrate 90. Droplets of ink 112 are shown being ejected through nozzles formed in tape 42 after ink ejection elements associated with each of the nozzles are energized.

Figure 14:
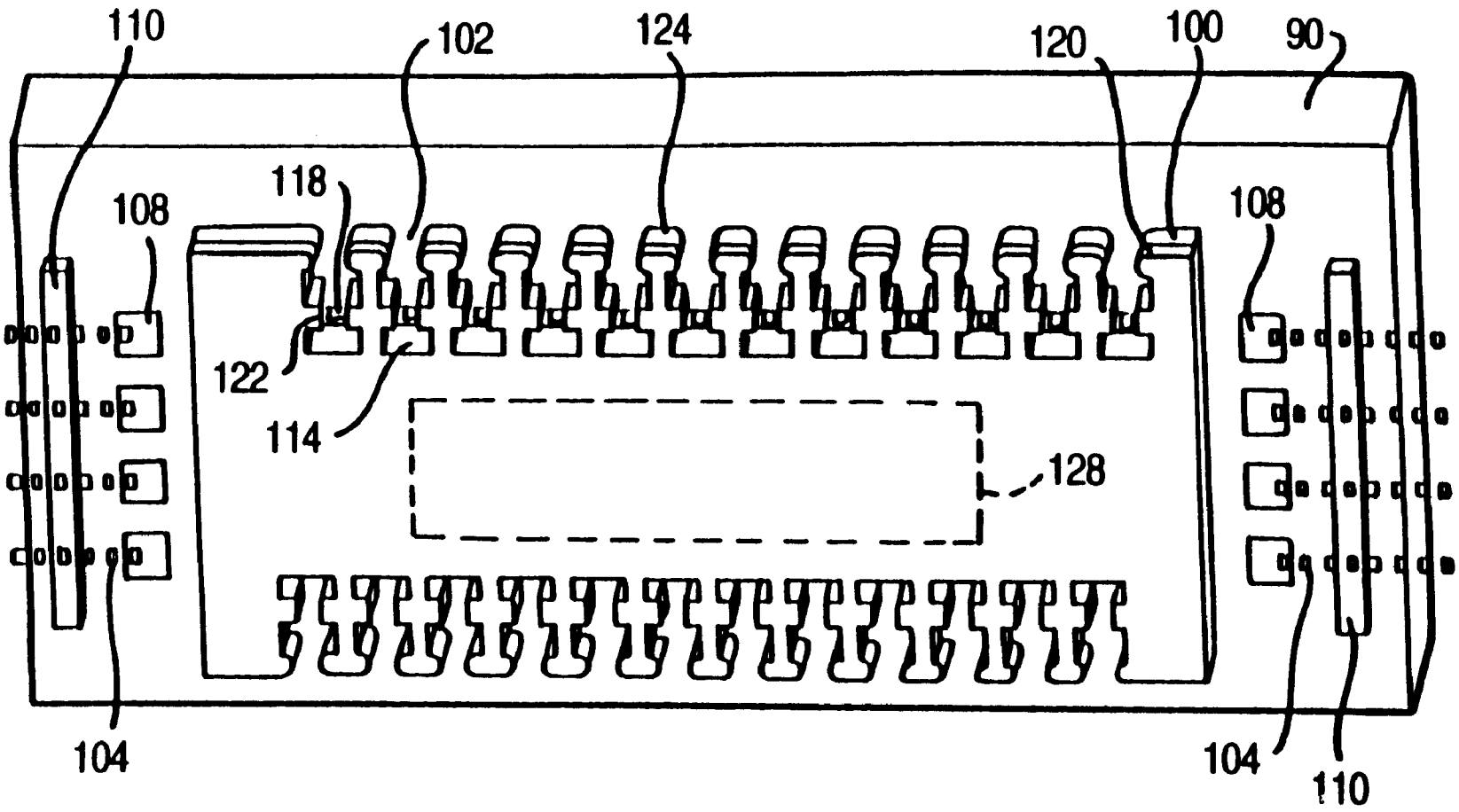
FIG. 14 is a perspective view of the printhead substrate showing the various ink ejection chambers and ink ejection elements formed on the substrate.

FIG. 14 is a simplified perspective view of substrate 90 containing ink ejection chambers 114, ink channels 102 leading to each ink ejection chamber 114, and ink ejection elements 118, which, in the preferred embodiment, are heater resistors. In an alternative embodiment, ink ejection elements 118 are piezoelectric elements. Barrier layer 100 in the preferred embodiment is a photoresist, such as Vacrel or Parad, and formed using conventional photolithographic techniques. An adhesive layer 120 is formed over barrier layer 100 to adhesively secure substrate 94 to the back of tape 42.

Constriction points 122 provide viscous damping during refill of ink ejection chambers 114 after firing. The enlarged areas 124 at the entrance way to each ink channel 102 increase the support area at the edges of barrier layer 100 so that the portion of tape 42 containing nozzles lies relatively flat on barrier layer 100 when affixed to barrier layer 100. Two adjacent enlarged areas 124 also act to constrict the entrance of the ink channels 102 so as to help filter large foreign particles.

Electrodes 108 are shown connected to phantom traces 104 after substrate 90 is affixed to tape 42 as previously described. Barrier portions 110 insulate traces 104 from the substrate 90 surface. Other embodiments of ink ejection chambers may also be used. In the preferred embodiment, the ink ejection chambers 114 are spaced to provide a print resolution of 600 dpi.

Circuitry on substrate 90 is represented by demultiplexer 128. Demultiplexer 128 is connected to electrodes 108 and distributes the electrical signals applied to electrodes 108 to the various ink ejection elements 118 in a way such that there are less electrodes 108 required than ink ejection elements 118. In the preferred embodiment, groups of ink ejection elements 118 are repeated, each group being referred to as a primitive. Addressing lines connected to electrodes 108 address one ink ejection element 118 at a time in each of the primitives. By requiring both the primitive to be addressed and a particular ink ejection element 118 in a primitive to be addressed at the same time, the number of electrodes 108 on substrate 90, and the number of contact pads 48 (FIG. 4) on a print cartridge 16, can be much less (e.g., 52) than the total number of ink ejection elements 118 (e.g., 300).

Additional information regarding this particular printhead structure may be obtained from U.S. application Ser. No. 08/319,896, filed Oct. 6, 1994, entitled "Inkjet Printhead Architecture for High Speed and High Resolution Printing," by Brian Keefe et al., assigned to the present assignee and incorporated herein by reference.

Figure 15:
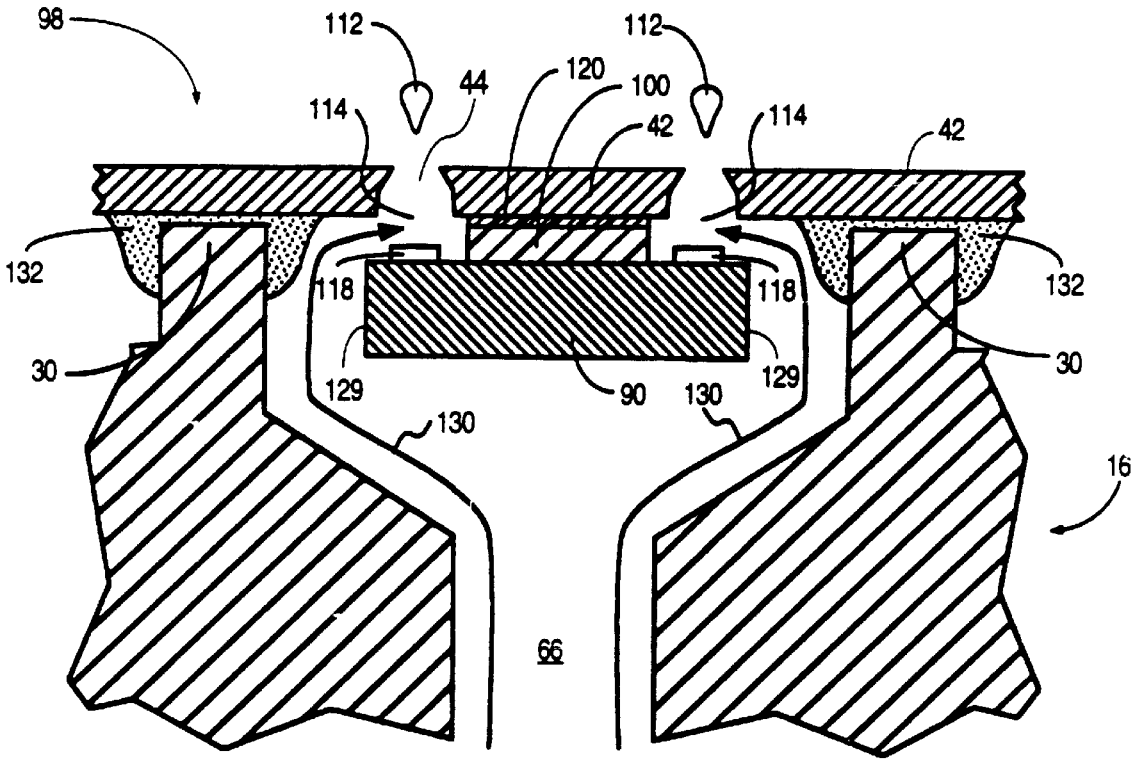
FIG. 15 is a cross-sectional view of the print cartridge of FIG. 3 taken along line 15—15 in FIG. 3 showing the feeding of ink around the outer edges of the substrate and into the ink ejection chambers.

FIG. 15 is a cross-sectional view along lines 15—15 in FIG. 3 showing ink being delivered from the collapsible ink bag 51 through primary ink channel 66 (also shown in FIG. 7), around the outer edges 129 of substrate 90 and into the ink channels 102 (FIG. 14) and ink ejection chambers 114. The path of ink is shown by arrows 130. Tape 42 having nozzles 44 formed therein is sealed around primary ink channel 66 by an adhesive 132.

Figure 16:
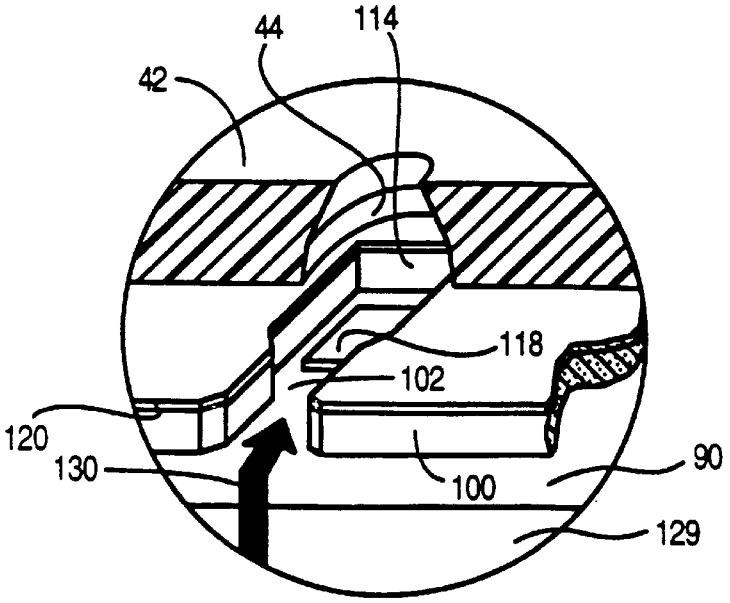
FIG. 16 is a partial cross-sectional view of the edge of the substrate and the flexible tape showing the delivery of ink around the edge of the substrate and into an ink ejection chamber.

FIG. 16 shows a close-up partial cross-section of the printhead assembly 98 showing a nozzle 44, a simplified ink ejection chamber 114, and various other elements making up the printhead assembly 98 described with respect to FIGS. 12–14. As seen, the ink path 130 flows around an outer edge 129 of substrate 90.

Figure 17:
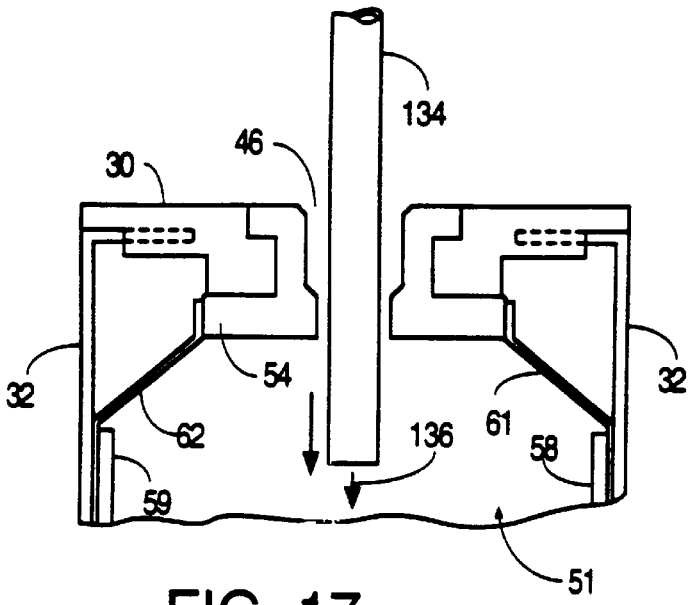
FIG. 17 is a partial cross-sectional view of the print cartridge of FIG. 3 taken along line 17—17 in FIG. 3 illustrating the initial filling of the print cartridge reservoir with ink.
Figure 18:
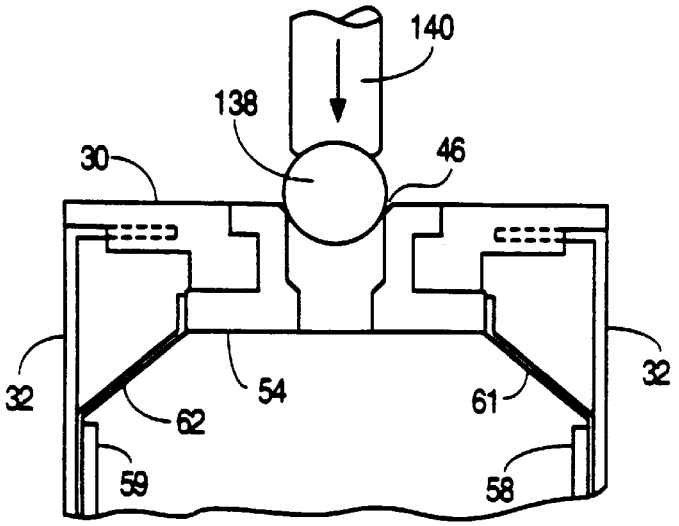
FIGS. 18 and 19 illustrate the insertion of a steel ball in the fill hole shown in FIG. 17 for permanently sealing the fill hole.
Figure 19:
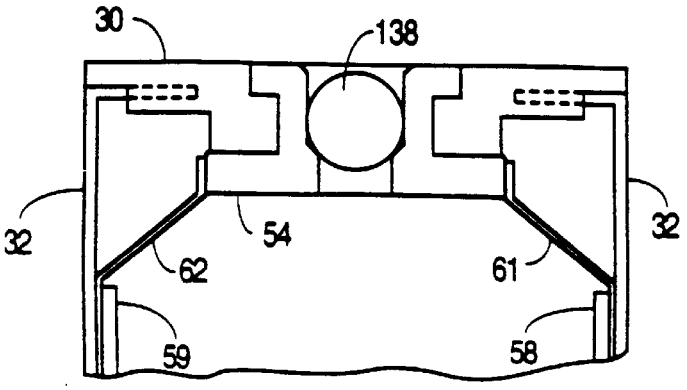

FIGS. 17–19 illustrate the preferred method of initially filling print cartridge 16 with ink through ink fill hole 46, best shown in FIG. 3. FIGS. 17–19 are taken along line 17–17 in FIG. 3 and show outer frame 30, side covers 32, inner frame 54, flexible ink bag sidewalls 61 and 62, and metal side plates 58 and 59. In a first step, the air in ink bag 51 is replaced with $CO_2$ by simply injecting $CO_2$ through ink fill hole 46. As described later, the $CO_2$ helps prevent air bubbles from forming in ink bag 51 after filling with ink. An ink delivery pipe 134 is then inserted through ink fill hole 46, and ink 136 is pumped into the empty ink bag 51 until the ink reaches fill hole 46. In the preferred method, pipe 134 is inserted to near the bottom of ink bag 51 to minimize ink splashing and the creation of foam.

Once ink bag 51 is full, a stainless steel ball 138 (FIG. 18) is pressed into ink fill hole 46 by a plunger 140 until the ball 138 is seated and firmly secured in fill hole 46, as shown in FIG. 19. Ball 138 is now intended to permanently seal ink fill hole 46, and any recharging of the ink in ink bag 51 will be performed via valve 24 in FIG. 3.

Print cartridge 16 is then positioned such that its snout is at the highest point, and any excess air is withdrawn through nozzles 44 using a vacuum pump sealed with respect to nozzles 44. A sufficient amount of ink is then sucked through nozzles 44 to create the initial negative pressure in ink bag 51 equivalent to about −3 to −4 inches of water. Due to the small diameter of nozzles 44 and the narrow width of the various ink channels, coupled with the ink viscosity, the negative pressure within ink bag 51 does not draw air through nozzles 44. In the preferred embodiment, the capacity of ink bag 51 is around 50 milliliters.

The completed print cartridge 16 is then used in the printer of FIG. 1 in a conventional manner, and ink bag 51 becomes progressively depleted, starting from an expanded state to a compressed state, all the time maintaining a negative pressure in ink bag 51.

Description of Ink Refill System 150

A preferred device for recharging print cartridge 16 via valve 24 will now be described.

Figure 20:
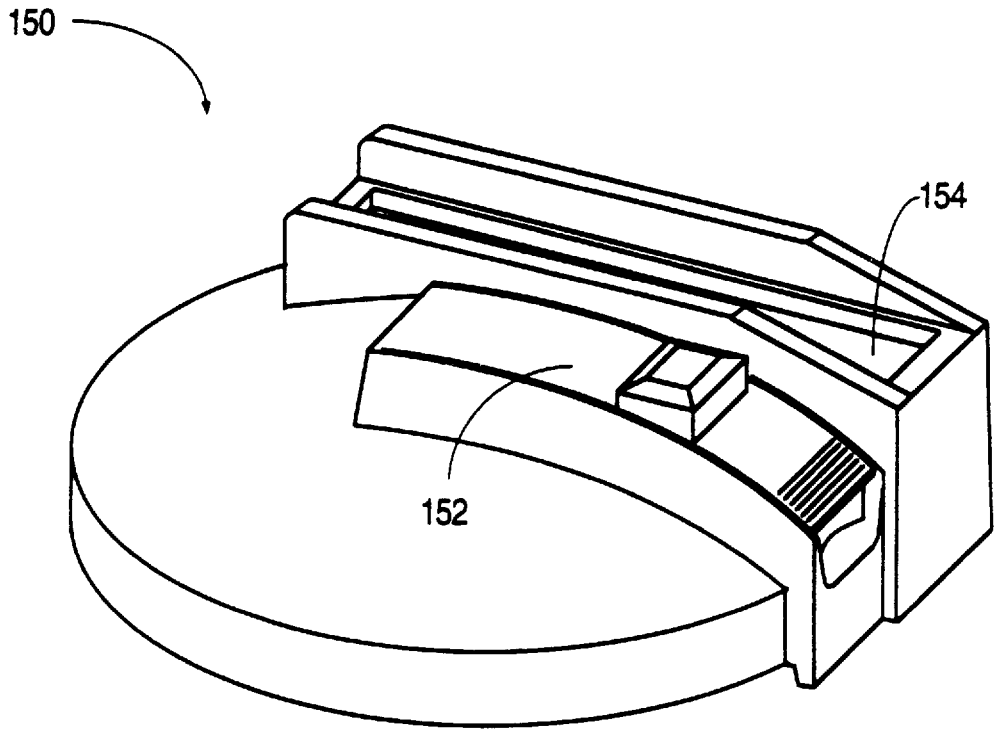
FIG. 20 is a perspective view of the preferred embodiment ink refill system in its initial state.

FIG. 20 is a perspective view of a preferred embodiment ink refill system 150 which contains a supply of ink sufficient for one refill of print cartridge 16. The concepts described with respect to the ink refill system 150 may be applied to a refill system containing any amount of ink. Ink refill system 150 includes a hinged cover portion 152 which protects an ink supply valve from inadvertent opening and prevents dust and other debris from accumulating in the valve. Ink refill system 150 also includes a foam pad 154 for cleaning nozzle member 40 (FIG. 3) of print cartridge 16 after refilling.

Figure 21:
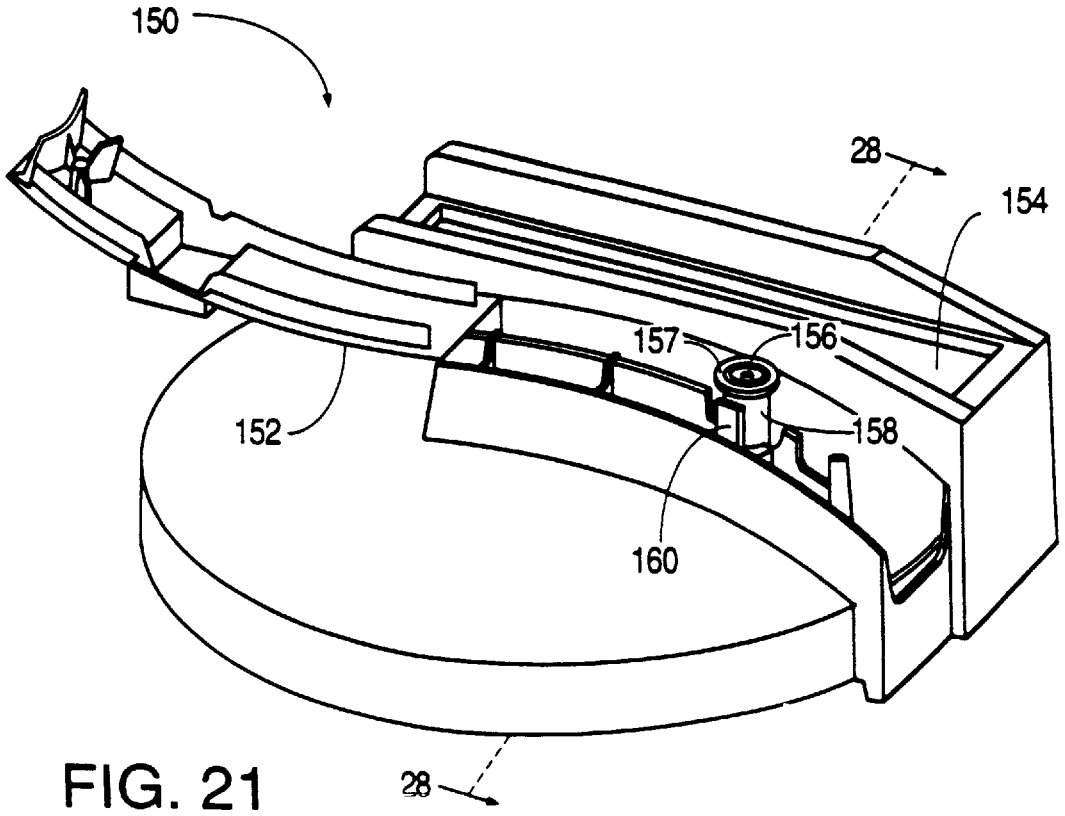
FIG. 21 is a perspective view of the ink refill system of FIG. 20 with its ink refill valve exposed in preparation for recharging the print cartridge of FIG. 3.

FIG. 21 illustrates ink refill system 150 after cover 152 has been opened to reveal valve 156, snap ring 157, cylindrical sleeve 158, and guide tab 160. Cylindrical sleeve 158 has an inner diameter slightly larger than the outer diameter of sleeve 26 (FIG. 5) of print cartridge 16. Snap ring 157 slides down along sleeve 158 once sufficient downward pressure is exerted on ring 157 by print cartridge 16 when engaging valves 24 and 156. The function of snap ring 157 will be described in detail later.

Figure 22:
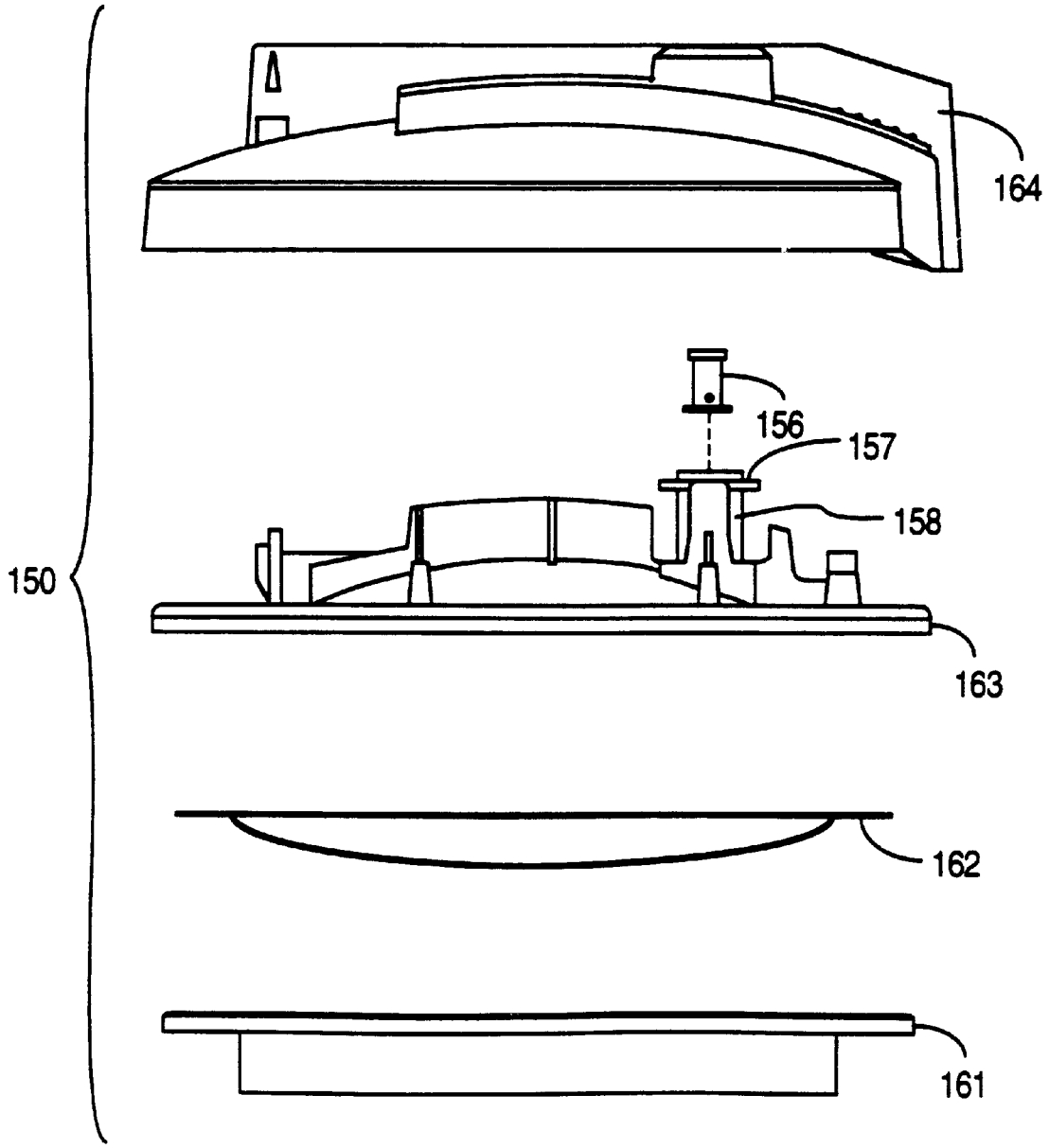
FIG. 22 is an exploded side view of the ink refill system of FIG. 20.

FIG. 22 is an exploded side view of ink refill system 150. Ink refill system 150 consists of a base 161, a flexible ink reservoir bottom 162, an ink reservoir top 163, a female type sliding valve 156 which engages the male type valve 24 in print cartridge 16, a snap ring 157, and top portion 164. The base 161, ink reservoir top 163, and top portion 164 may be injection molded using a suitable plastic. Ink reservoir bottom 162 is formed of a flexible film such as Mylar or EVA. Such a flexible film may be the nine-layer film described in U.S. Pat. No. 5,450,112, incorporated herein by reference. Valve 156 is preferably formed of the same material which forms valve 24 on the print cartridge 16, such as LDPE or other low friction polymer.

Figure 23A:
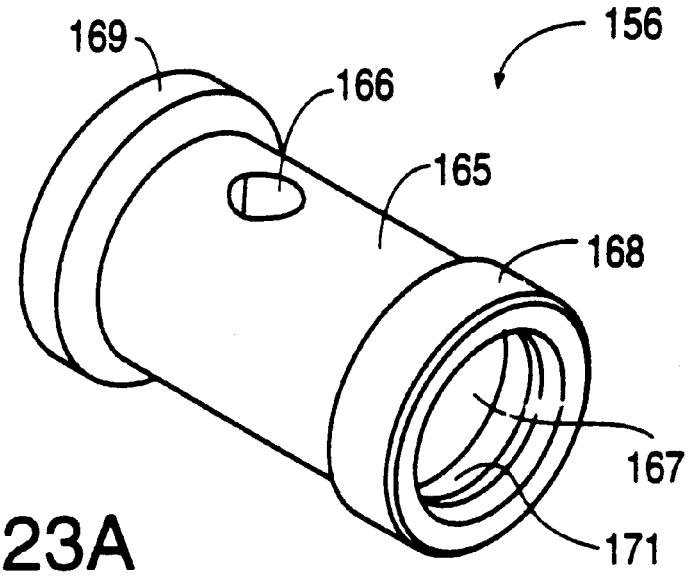
FIGS. 23A and 23B are perspective views of the slideable valve used in the preferred ink refill system.
Figure 23B:
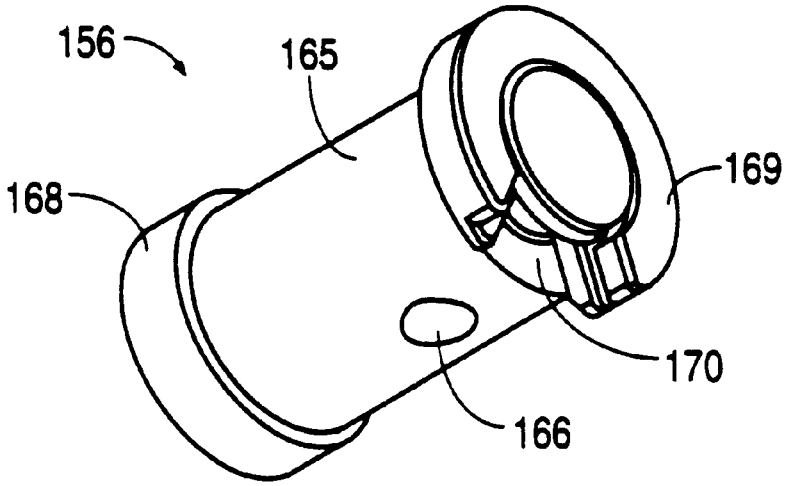

Additional detail of valve 156 is shown in FIGS. 23A and 23B. In the preferred embodiment, valve 156 consists of a hollow shaft portion 165 having a hole 166 formed in the side of shaft portion 165 and an opening 167 in the top of shaft portion 165. A first rib 168 limits the downward travel of valve 156 into the ink reservoir. A clip 169 is resiliently secured to the end of shaft portion 165 around an annular notch 170 formed in shaft portion 165 to limit the upward travel of valve 156 out of the ink reservoir. Clip 169 may be formed of high density polyethylene (HDPE), polycarbonate, or other suitable material. An annular recess 171 (shown in greater detail in FIG. 31) is formed near the top of valve 156 in which seats rib 96 (FIG. 10A) on valve 24 when the two valves are engaged. In the preferred embodiment, the length of valve 156 is 0.423 inches; however, an acceptable range may be approximately 0.25 to 1.0 inch depending on design factors such as ergonomics and reliability. The outer diameter of valve 156 is approximately 0.206 inches but can be virtually any diameter.

Figure 24:
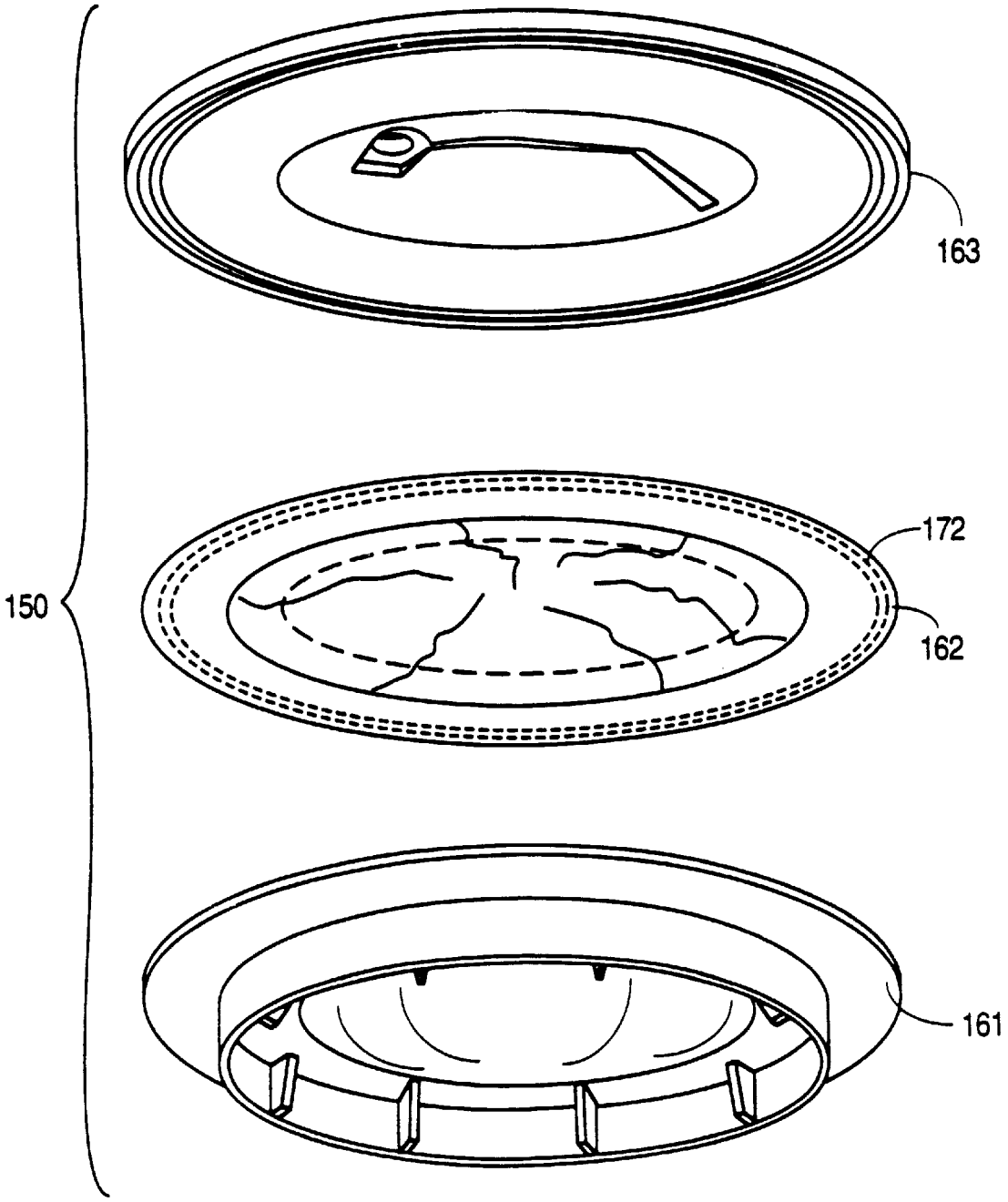
FIG. 24 is an exploded perspective view of the ink refill system of FIG. 20.

FIG. 24 is an exploded perspective view of ink refill system 150 showing the convex bottom portion of base 161, the flexible ink reservoir bottom 162, and the underside of the ink reservoir top 163. In the preferred embodiment, the periphery of the flexible ink reservoir bottom 162 is ultrasonically welded to the periphery of ink reservoir top 163 in the area between dashed lines 172. After ink reservoir bottom 162 has been secured to ink reservoir top 163, the peripheral portions of base 161 are then ultrasonically welded to the peripheral portions of ink reservoir top 163.

Figure 25:
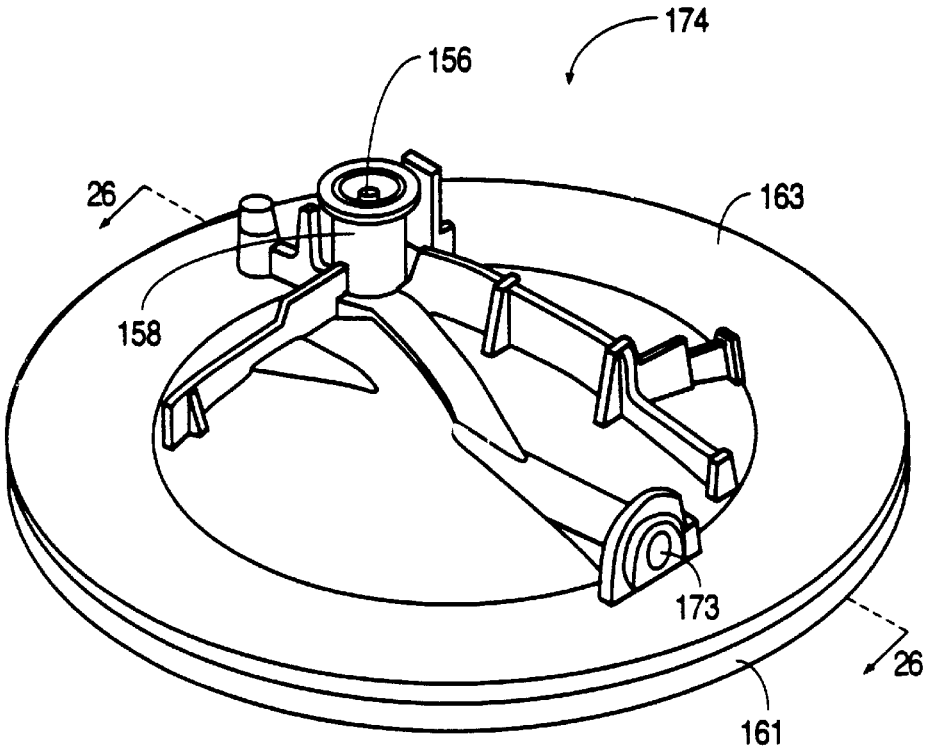
FIG. 25 is a top perspective view of the ink refill system of FIG. 20 with the top cover removed showing both the ink refill valve and the ink fill hole for the ink refill reservoir.

FIG. 25 is a top perspective view of the ink refill system 150 with the top portion 164 (FIG. 22) removed to better show valve 156, sleeve 158 and fill hole 173. The remaining structure of ink reservoir top 163 supports the curved top portion 164 shown in FIG. 22. The structure of FIG. 25 will be referred to as an intermediate structure 174.

Figure 26:
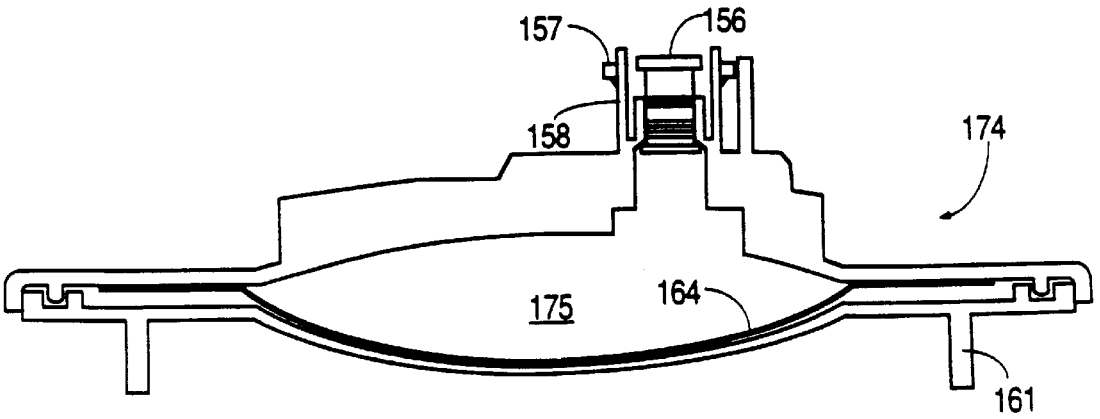
FIG. 26 is a cross-sectional view of the ink refill system of FIG. 25 taken along line 26—26 in FIG. 25 showing the refill valve in the closed state and the ink reservoir empty.

FIG. 26 is a cross-section of the intermediate structure 174 of FIG. 25 taken along line 26—26 in FIG. 25. At this point in the manufacturing process, the ink reservoir 175 within ink refill system 150 is empty, and valve 156 is in its closed position as shown in FIG. 26.

Figure 27:
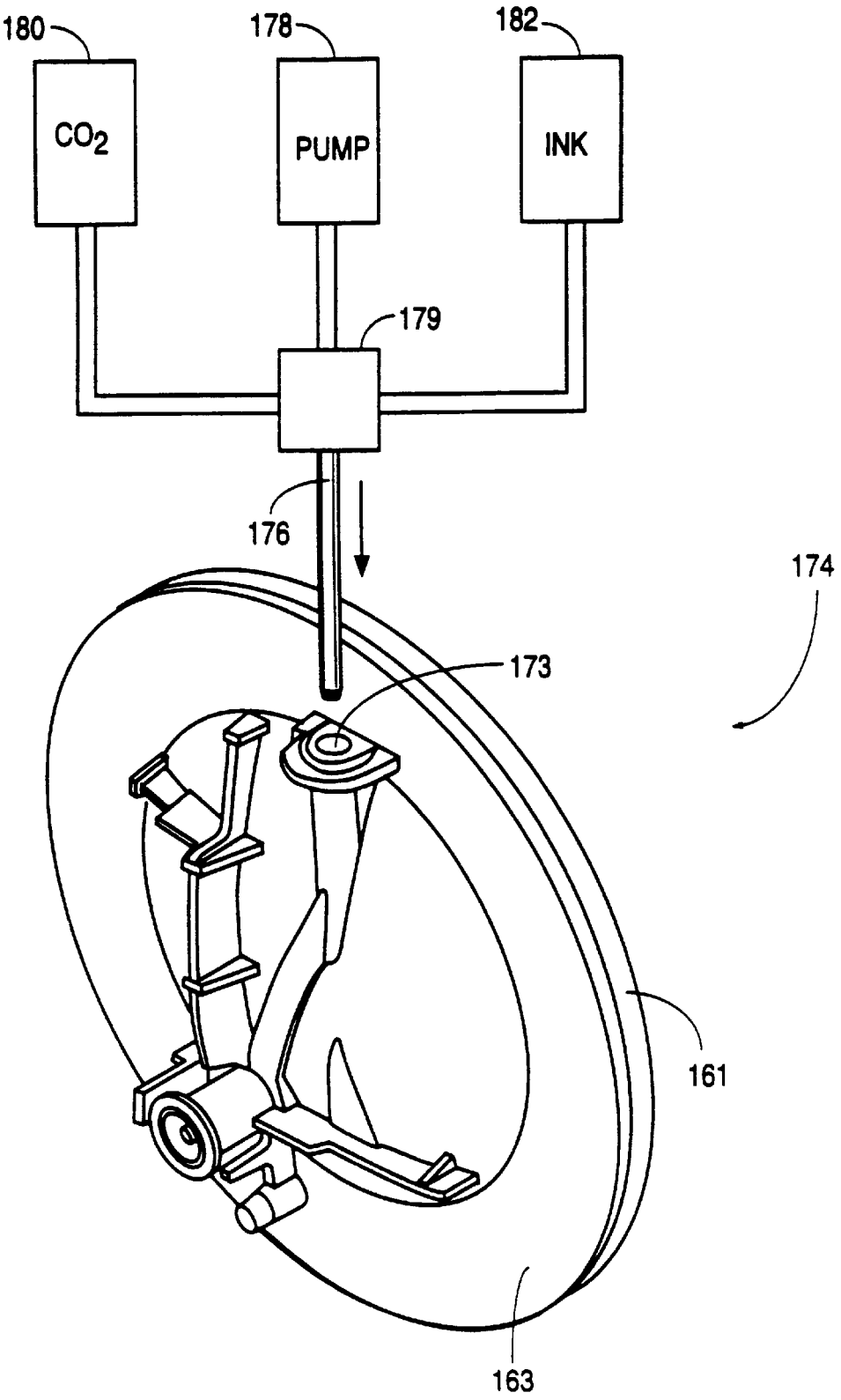
FIG. 27 is a schematic illustration of the preferred technique for filling the ink refill system with ink.

The procedure for filling ink reservoir 175 is illustrated in FIG. 27. In a first step, the intermediate structure 174 has its ink fill hole 173 facing upwards to allow filling of ink reservoir 175 with ink. A hollow pipe 176 is inserted into ink fill hole 173, and any air in ink reservoir 175 is pumped out using pump 178. At this point, the flexible ink reservoir bottom 162 will be substantially flush against the upper surface of the ink reservoir top 163.

Next, pipe 176 is connected via a suitable valve 179 to a carbon dioxide supply 180, and $CO_2$ is pumped through pipe 176 to now fill ink reservoir 175 with $CO_2$. This will expand the flexible ink reservoir bottom 162 to its position shown in FIG. 26.

Next, substantially all of the $CO_2$ is pumped out by pump 178. A small amount of $CO_2$ will inherently remain in ink reservoir 175, which is preferable over air. The ink used will typically be water based. In water, $CO_2$ has a much higher solubility than air. Hence, the $CO_2$ will be completely absorbed by the ink, since any residual $CO_2$ remaining after the purging step will not be enough to saturate the ink. However, because the $CO_2$ may not be completely pure, there may be still some tolerable air bubbles forming. Hence, purging ink reservoir 175 with $CO_2$ virtually eliminates problems stemming from gas bubbles forming in ink reservoir 175 after being filled with ink.

In a next step, valve 179 allows degassed ink from ink supply 182 to flow through pipe 176 to fill ink reservoir 175. The ink is degassed in order to allow it to absorb any non-$CO_2$ impurities that remain after flushing ink reservoir 175 with $CO_2$.

The preferred ink is a pigment-based ink incorporating particles (e.g., carbon black) suspended in fluid. Such pigment based ink is preferred over a dye-based ink due to the pigment based ink's higher optical density and permanence. However, either type of ink may be used. Some types of inks which may be used are described in U.S. Pat. Nos. 5,180,425, 5,085,698, and 5,180,425, all incorporated herein by reference.

Figure 28:
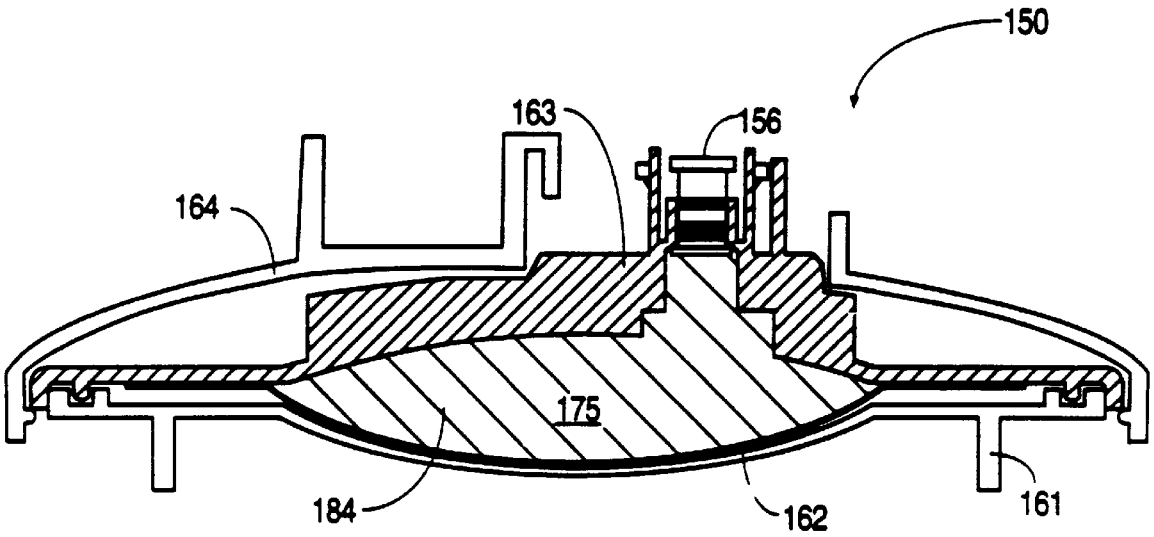
FIG. 28 is a cross-sectional view of the ink refill system of FIG. 21 taken along line 28 28 in FIG. 21 after the ink refill reservoir has been filled with ink in accordance with FIG. 27.

Pipe 176 is then removed and a plastic plug is inserted into ink fill hole 173 to permanently seal ink fill hole 173. Top portion 164 (FIG. 22) is then snapped over ink reservoir top 163 to complete the ink refill system 150 structure. A cross-section of the now filled ink refill system 150 is shown in FIG. 28, taken along line 28—28 in FIG. 21. Ink 184 is shown completely filling ink reservoir 175.

Recharging Of Print Cartridge 16 Using Ink Refill System 150

Figure 29:
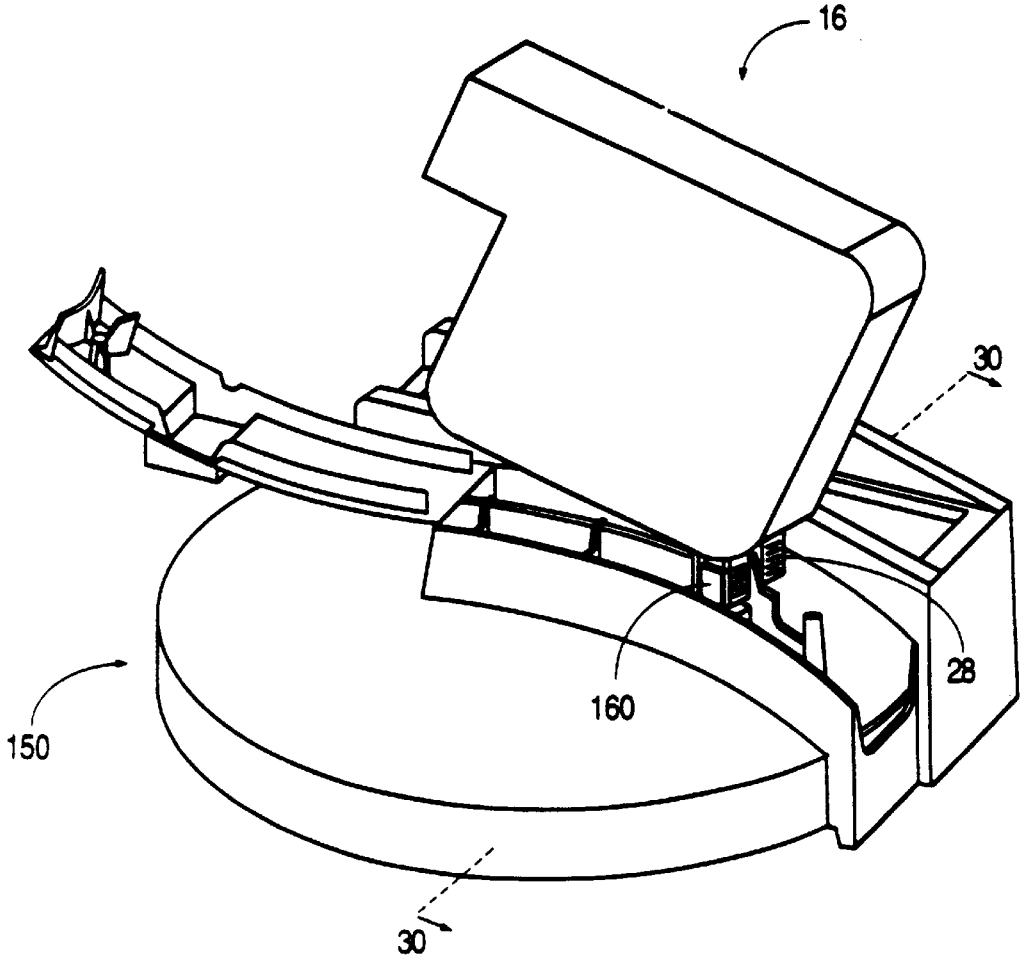
FIG. 29 illustrates the print cartridge of FIG. 3 engaging the ink refill system of FIG. 21 for recharging the ink reservoir in the print cartridge.

FIG. 29 illustrates the proper position of print cartridge 16 with respect to ink refill system 150 when recharging the ink supply in print cartridge 16. Print cartridge 16 is positioned so that cylindrical sleeve 26 (FIG. 3) on print cartridge 16 is received by cylindrical sleeve 158 (FIG. 21) on ink refill system 150. Other techniques for supporting print cartridge 16 in its desired position may use any suitable engaging members on the print cartridge 16 and ink refill system 150. Guide tab 160 is used to enforce the preferred orientation of print cartridge 16 on ink refill system 150.

In the preferred method, ink refill system 150 is supported on a table top, and the user pushes print cartridge 16 down on the valve portion of ink refill system 150 until valves 24 and 156 are engaged and ink bag 51 and ink reservoir 175 are in fluid communication.

Figure 30:
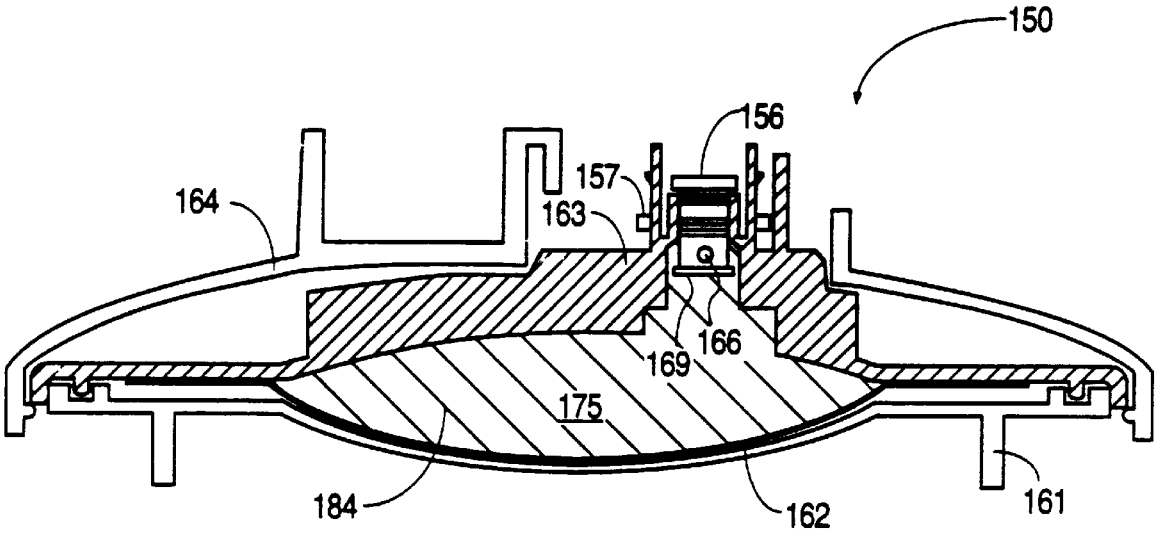
FIG. 30 is a cross-sectional view of the ink refill system of FIG. 29 taken along line 30—30 in FIG. 29 illustrating the refill valve being now open by the engagement of the print cartridge with the ink refill system.

FIG. 30 is a cross-section of ink refill system 150 taken along line 30—30 in FIG. 29, now showing valve 156 in its down or open position so that ink from ink reservoir 175 may flow through hole 166 and through the top of valve 156. The bottom portion of valve 156 is sealed and supports annular clip 169, also shown in FIG. 23B. Snap ring 157 is shown in its down position due to the downward force of print cartridge 16 on ink refill system 150.

Figure 31:
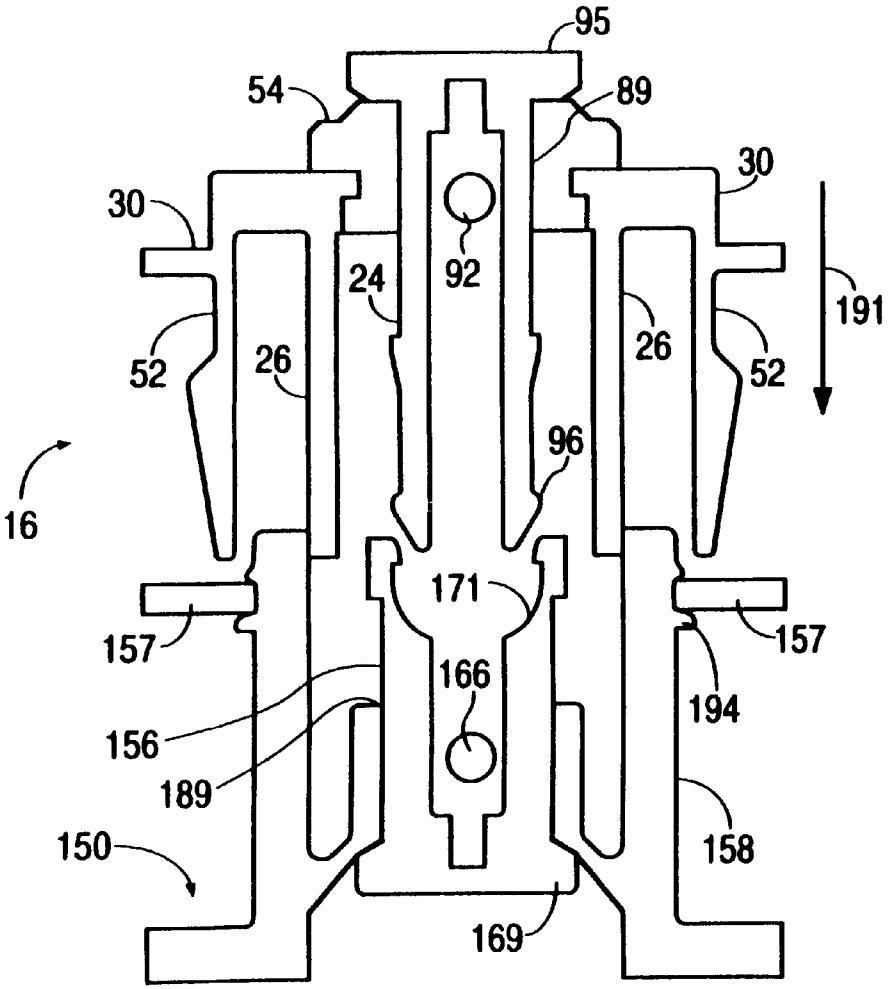

The engagement of valves 24 and 156, the function of snap ring 157, and the opening and closing of valves 24 and 156 are described with respect to FIGS. 31–34. In FIG. 31, print cartridge 16 and ink refill system 150 have not yet been engaged, and both valves 24 and 156 are in a closed position. More specifically, hole 92 in slideable valve 24, which leads to a middle bore in valve 24, is fully blocked by a surrounding seal 89 formed by inner frame 54, best shown in FIG. 9. The top portion of valve 24 is in direct contact with ink within the ink bag 51 (FIG. 7) in print cartridge 16. Valve 156 in the ink refill system 150 is similarly shown in a closed state with the ink in ink reservoir 175 being at or very proximate to the bottom portion of valve 156. A seal 189 formed in ink reservoir top 163 surrounds valve 156 and blocks hole 166.

Also shown in FIG. 31 are support flanges 52, which provide added support for handle 28 (FIG. 5), and snap ring 157, supported by annular rib 194 on sleeve 158. Print cartridge 16 is shown moving in a downward direction indicated by arrow 191, and sleeve 26 on print cartridge 16 is about to slide within sleeve 158 on ink refill system 150.

Figure 32:
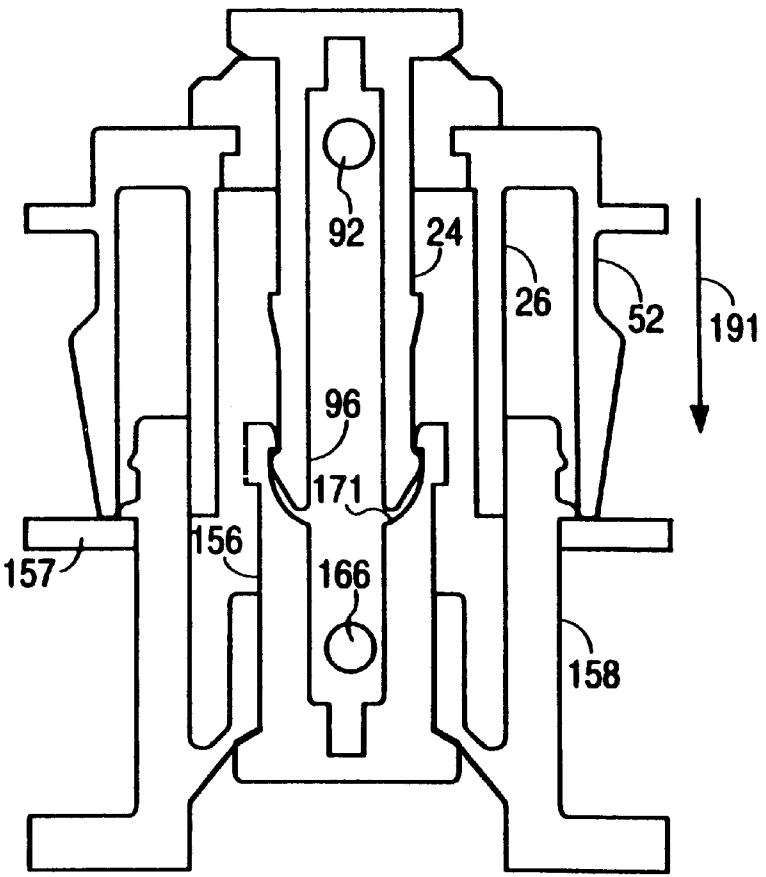
FIGS. 31, 32, 33 and 34 illustrate various positions of the valves on the print cartridge and the ink refill system as the print cartridge is engaged and then disengaged from the ink refill system.

As shown in FIG. 32, upon further downward movement of print cartridge 16, flanges 52 contact snap ring 157. This provides added resistance to the downward movement of print cartridge 16, and the user must now provide an added force to cause snap ring 157 to override rib 194. As soon as snap ring 157 rides over rib 194, the user receives a tactile feedback, and the downward movement of print cartridge is naturally accelerated by the release of snap ring 157 over rib 194.

At the same time, rib 96 near the tip of valve 24 engages the recess 171 in valve 156 to mechanically couple valves 24 and 156 together in a fluid tight seal. The added momentum of the print cartridge 16 when snap ring 157 rides over rib 194 ensures the coupling of valves 24 and 156. The friction between valve 24 and inner frame 54 and the friction between valve 156 and seal 189 is sufficiently high so that rib 96 engages recess 171 before valves 24 and 156 slide into their open positions. Some overtravel is allowed by rib 96 within recess 171 to provide an additional tactile feedback to the user indicating that the valves 24 and 156 are now engaged. Engagement of rib 96 and recess 171 is also important to enable the valves to be automatically pulled closed when print cartridge 16 is later removed from ink refill system 150.

Cylindrical sleeve 26 on print cartridge 16 is now engaging cylindrical sleeve 158 on ink refill system 150 to ensure that valves 24 and 156 are centered with respect to one another as well as to limit the side-to-side movement of print cartridge 16.

Figure 33:
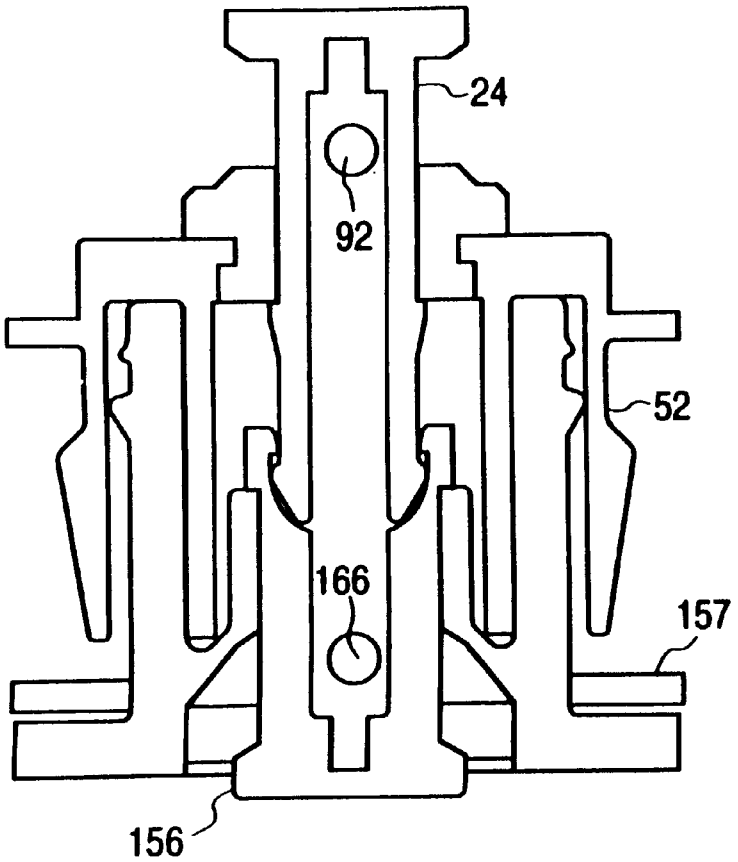

In FIG. 33, upon further downward force of print cartridge 16 on ink refill system 150, valve 156 slides downward so that hole 166 is now within ink reservoir 175. This same downward movement also causes valve 24 to now slide into its open position so that hole 92 is now within the ink bag 51 (FIG. 7) in print cartridge 16. A fluid channel now exists between ink reservoir 175 and the negative pressure ink bag 51 within print cartridge 16.

The negative pressure in ink bag 51 now draws ink from ink reservoir 175 into ink bag 51 to fill the ink bag 51 and substantially drain the ink in ink reservoir 175. This process is relatively slow due to the low negative pressure and may take on the order of one to three minutes.

The placement of print cartridge 16 on ink refill system 150 as shown in FIG. 29 causes ink bag 51 to be at a predetermined height above ink reservoir 175 such that a negative pressure is always retained in ink bag 51, and ink bag 51 cannot overfill. In the preferred embodiment, the center of ink bag 51 is approximately 2.5 inches above the center of ink reservoir 175. The relative heights of ink bag 51 above ink reservoir 175 is affected by the angle of print cartridge 16 with respect to ink reservoir 175, which in the preferred embodiment is approximately 20 degrees. Other angles and heights are suitable depending on the desired negative pressure in the ink bag used. Accordingly, no matter how much ink is initially in ink bag 51 and ink reservoir 175 prior to recharge, ink bag 51 does not overfill and the resultant negative pressure in ink bag 51 is always the same.

The placement of valve 24 within handle 28 enables the print cartridges 16 to be at its preferred angle shown in FIG. 29. Handle 28 also serves to protect valve 24 during manufacturing and during handling by the user. Additionally, the handle 28 and valve 24 are easily accessible when print cartridge 16 is installed in a printer.

Figure 34:
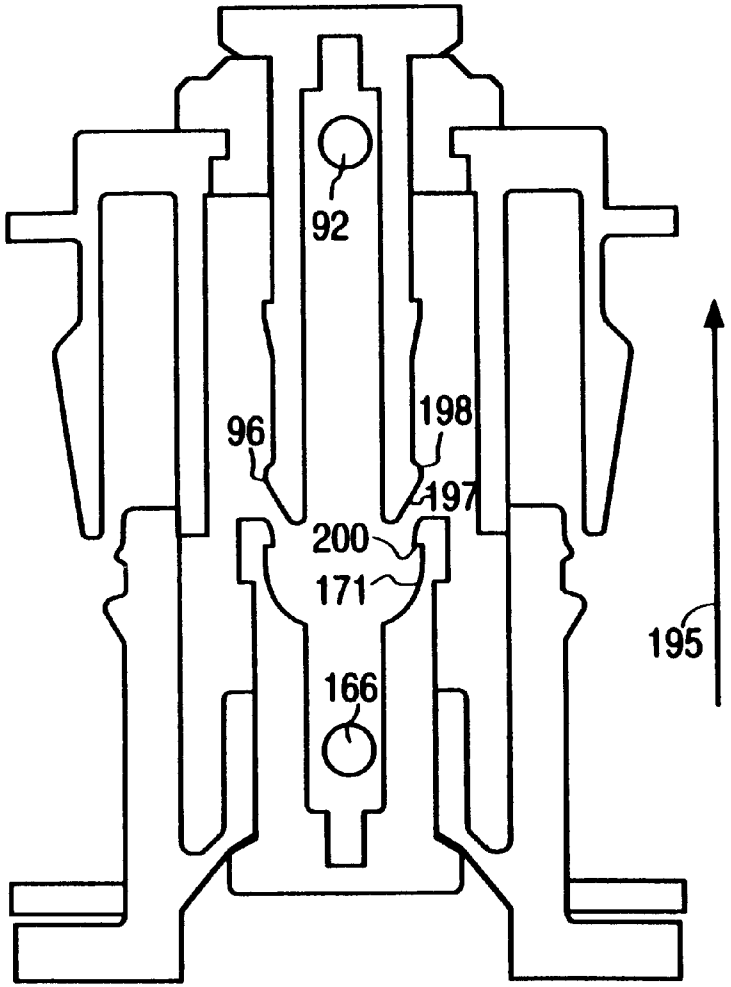

Once the ink bag 51 in print cartridge 16 is full, print cartridge 16 is then lifted from ink refill system 150, as illustrated in FIG. 34, in the direction of arrow 195. In FIG. 34, the lifting of print cartridge 16 closes valve 156 and valve 24 to thus seal off the ink bag 51 in print cartridge 16. Further lifting causes valves 24 and 156 to become disengaged from one another. This is because the friction which is overcome to disconnect the valves is greater than the friction which is overcome to close the valves.

Figure 35:
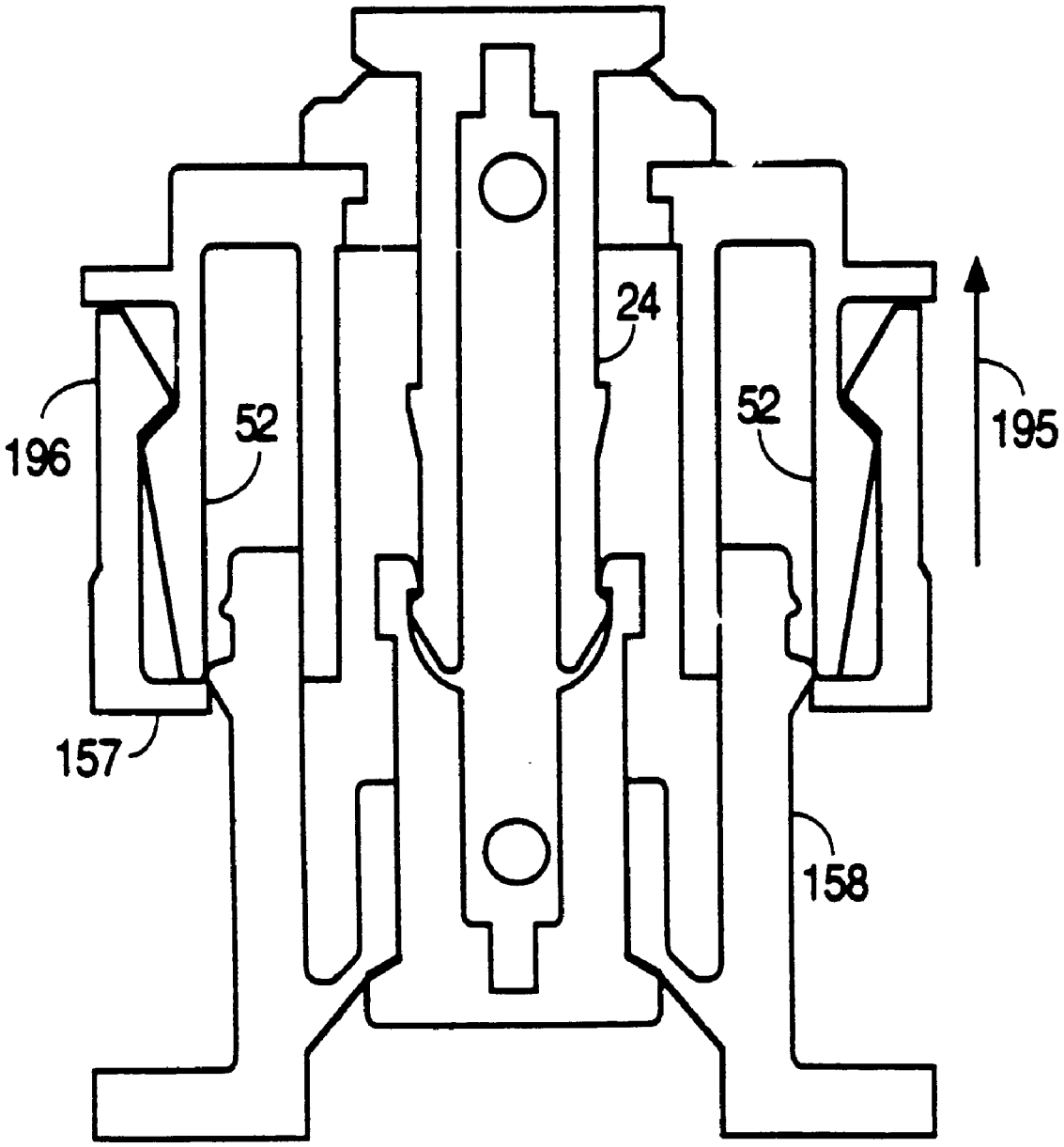
FIG. 35 illustrates one embodiment of a reusable snap ring during a refilling process.

FIG. 35 illustrates a different embodiment snap ring 157 which may be used if ink reservoir 175 contains more than a single supply of ink or is otherwise reusable. In FIG. 35, snap ring 157 includes resilient tabs 196 which engage with flanges 52. When print cartridge 16 is then lifted, snap ring 157 is lifted back in position on sleeve 158.

As seen in FIGS. 31–35, valves 24 and 156 mechanically engage prior to opening and mechanically disengage after being closed upon removal of print cartridge 16 from ink refill system 150. This is accomplished by forming the rib 96 on valve 24 such that it is engageable with recess 171 with less force than it takes to disengage rib 96 from recess 171. This may be achieved by forming the bottom portion 197 (FIG. 34) of rib 96 to have a slight angle (e.g., 30°) with respect to the axis of valve 24 to more easily enter through the opening in valve 156 and engage recess 171. The top portion 198 (FIG. 34) of rib 96 is then formed to have a steeper angle (e.g., 60°) with respect to the axis of valve 24 to make it more difficult to disengage rib 96 from recess 171. Additionally, recess 171 may be formed to have a more horizontal upper lip 200 (FIG. 34) so as to make it more difficult to disengage rib 96 from recess 171 than to engage rib 96 and recess 171. Other ways of providing such relative forces may be used instead of the two techniques described herein.

In alternative embodiments, other techniques are used to increase the reliability that valves 24 and 156 have engaged prior to the valves being opened or have closed after a recharge. Such techniques include using a lever-activated flag which pops up once the valves are properly engaged, increasing the sliding force of valves 24 and 156, spring loading valves 34 and 156 to ensure they are closed after the print cartridge 16 has been removed from the ink refill system 150, and forming a tab near sleeve 158 which impedes the motion of the print cartridge 16, similar to snap ring 157, to increase the downward momentum of print cartridge 16 before valves 24 and 156 have been engaged.

Figure 36:
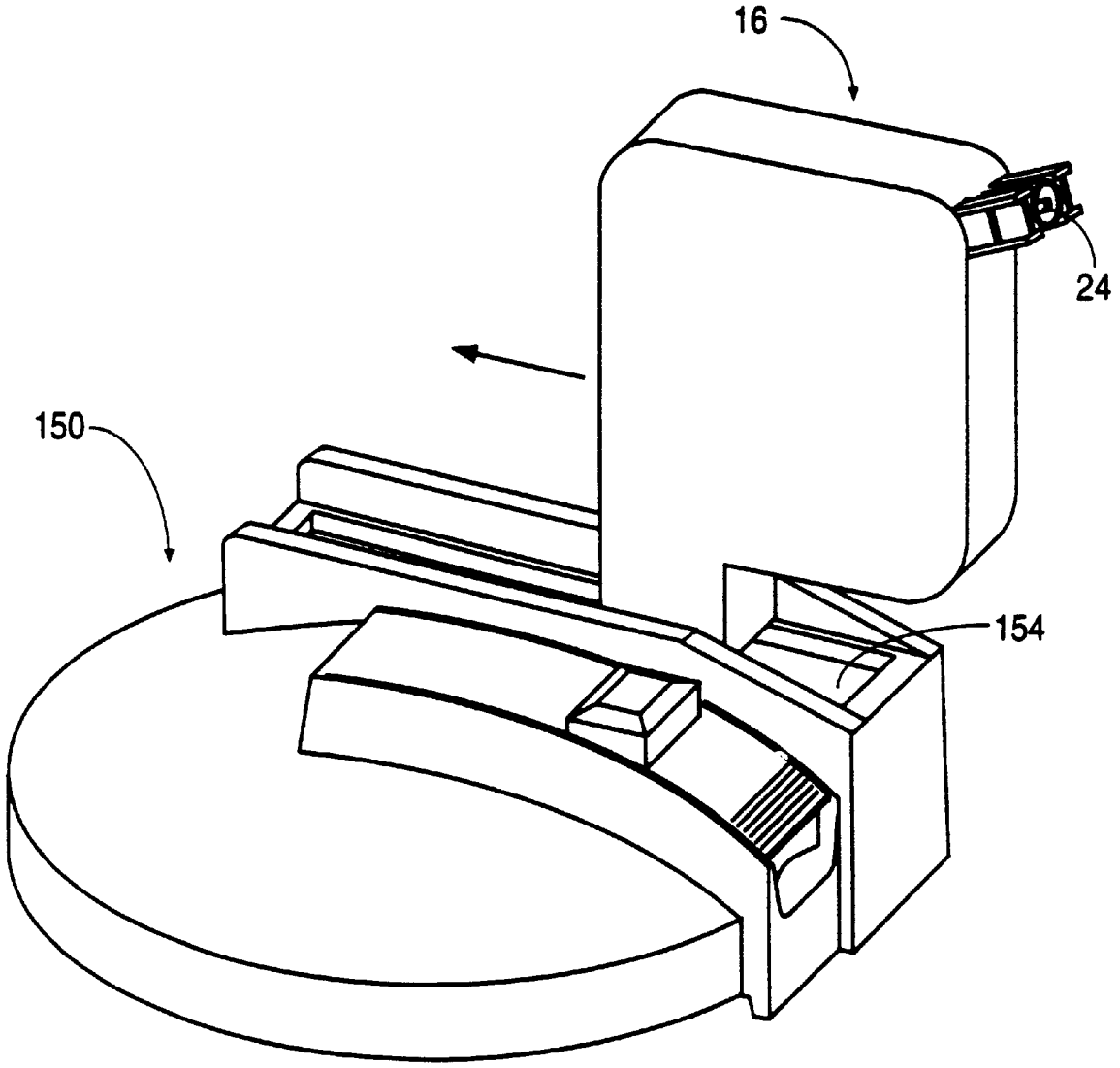
FIG. 36 illustrates the wiping of the printhead nozzles after refilling the print cartridge to clean the nozzle area.

Once the ink bag 51 has been recharged, as determined by either the ink level indicator described with respect to FIG. 6 or by allowing print cartridge 16 to engage ink refill system 150 for a predetermined period of time, the nozzle member 40 portion (FIG. 3) may be wiped by a foam pad 154 containing an appropriate cleaning solution, as shown in FIG. 36. A tape (not shown) is initially provided over foam pad 154 which prevents evaporation of the cleaning fluid until the tape is removed prior to cleaning the nozzle member 40. Print cartridge 16 is preferably wiped only one time across foam pad 154 to insure that ink particles which have been removed do not again come in contact with nozzle member 40.

Print cartridge 16 is then reinserted into carriage 18 (FIG. 1).

In the preferred embodiment, the inkjet printer 10 (FIG. 1) includes an automatic service station which creates a seal over nozzles 44 (FIG. 3) and primes the printhead using a vacuum pump. This withdrawing of ink from ink bag 51 ensures that ink is now in the ink ejection chambers in the printhead ready for firing.

Accordingly, a preferred rechargeable inkjet print cartridge has been described along with a preferred ink refill system and method for recharging the print cartridge with the refill system. Other types of valves and seals may be used to perform the automatic opening and closing function of the preferred valves, and such alternative embodiments are envisioned in this invention.

Alternative Embodiment Refill System

Figure 37:
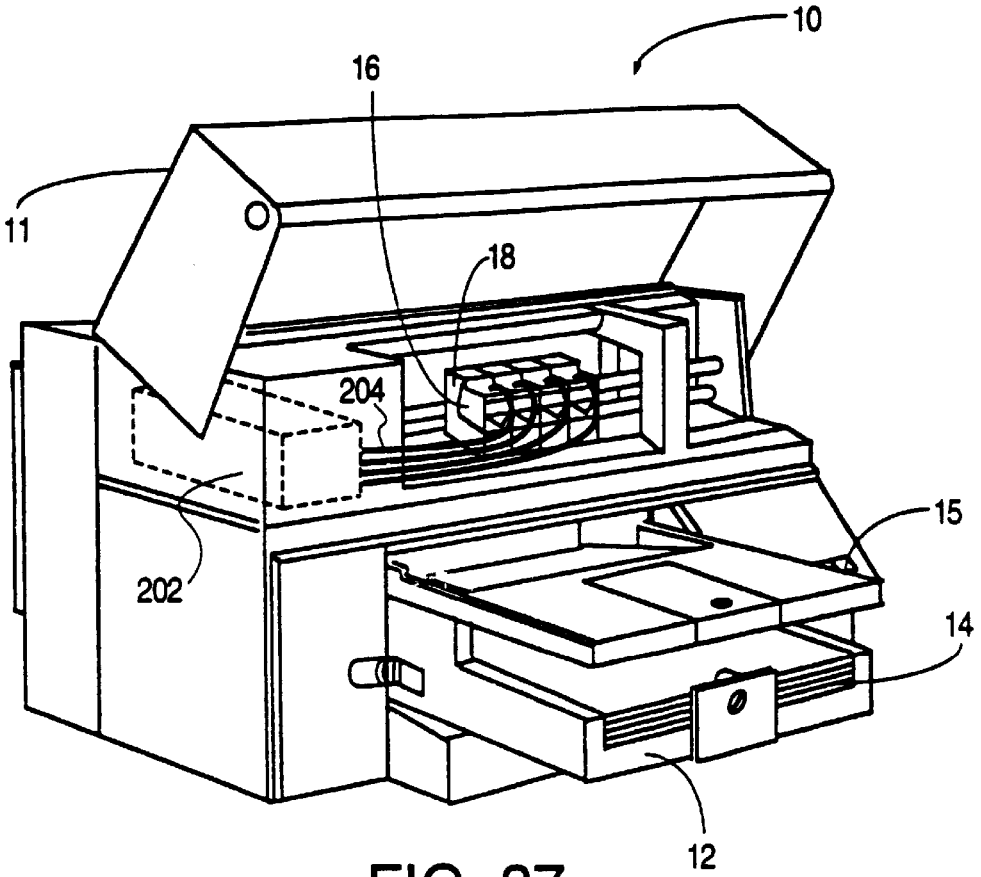
FIG. 37 is a perspective view of an alternate embodiment inkjet printer where hoses are connected between the valves of the print cartridges and a separate ink supply to refill the print cartridges.
Figure 38:
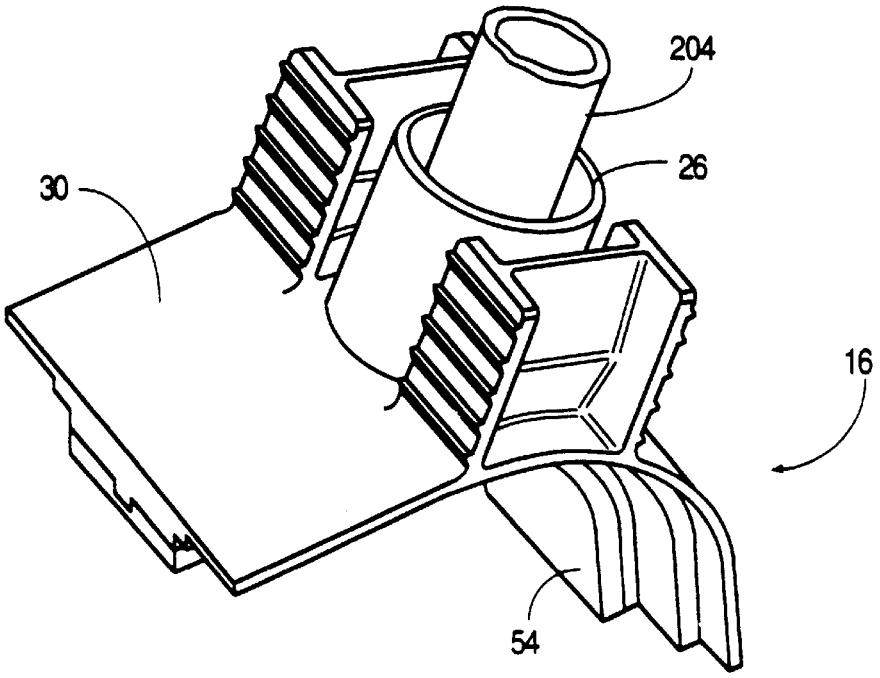
FIG. 38 is a close-up view of the valve portion of the print cartridge having a hose extending therefrom.

FIGS. 37 and 38 illustrate an alternative embodiment which provides either a continuous refill of the ink bag 51 within print cartridge 16 or intermittent filling of each print cartridge 16 during various times that printer 10 is activated.

Printer 10 in FIG. 37 may be identical to that shown in FIG. 1 but further houses a replaceable ink reservoir 202, shown in dashed outline, containing black, cyan, magenta, and yellow ink for the four print cartridges 16 supported in scanning carriage 18. Instead of valve 156 in FIG. 28 communicating with ink reservoir 175 in the preferred ink refill system 150, hoses 204 contain such valves 156 and are engageable and disengageable from valve 24 in print cartridge 16 in a manner identical to that described with respect to FIGS. 31–34.

FIG. 38 illustrates one hose 204 extending from cylindrical sleeve 26 on print cartridge 16.

As ink is being depleted from the ink bag 51 within each print cartridge 16 while printing, capillary action draws ink through flexible hoses 204 into their respective print cartridges 16. Alternatively, refilling may occur at predetermined times, such as at the end of a printing cycle or at other times.

In another embodiment, valve 24 is removed from print cartridge 16 and the end of hose 204 is provided with a simple male type tip which is inserted through the now empty hole through outer frame 30 and inner frame 54 to create a fluid seal. In another embodiment, the end of hose 204 is simply pushed over the end of valve 24.

The embodiments of FIGS. 37 and 38 have certain drawbacks which include the possibility of air residing in hoses 204 when initially connecting hoses 204 or when changing ink supply 202.

Needle and Septum Alternative to Refill Valves

Figure 39:
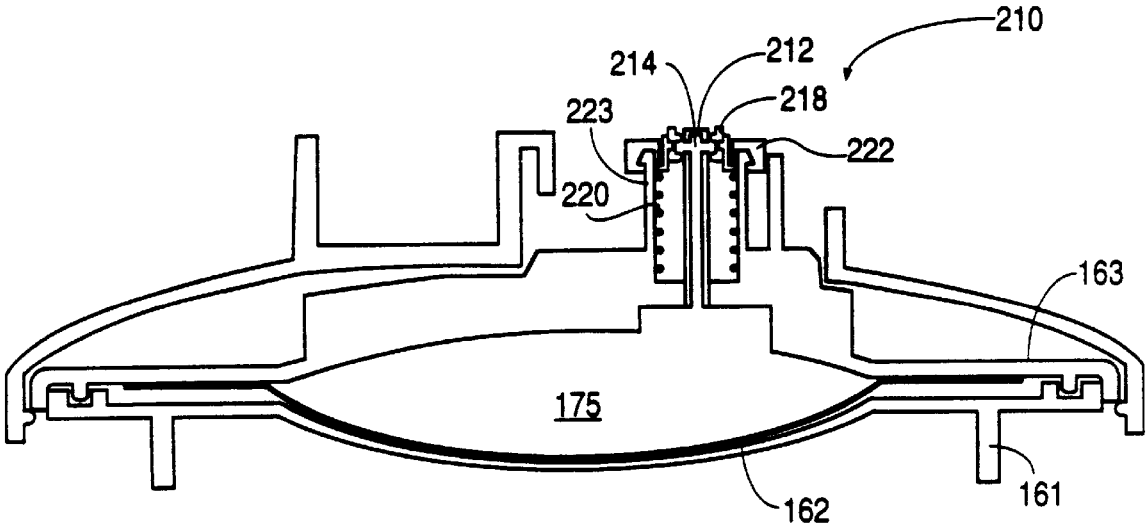
FIG. 39 is a cross-section of an ink refill system similar to that shown in FIG. 28 but using a needle and septum instead of a sliding valve.
Figure 40:
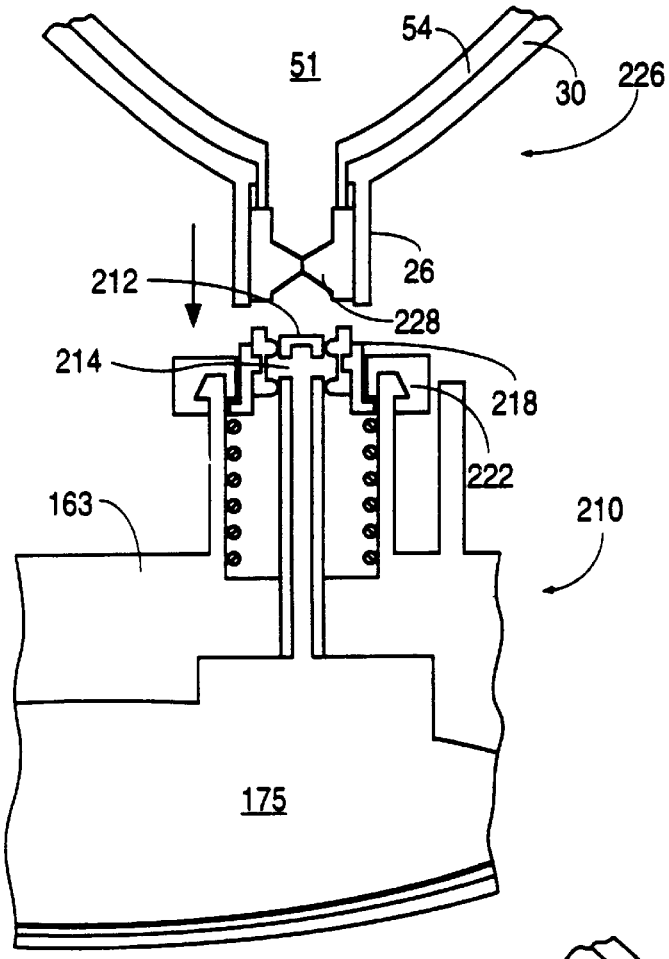
FIG. 40 is a close-up view of the print cartridge septum about to engage the ink refill system needle.
Figure 41:
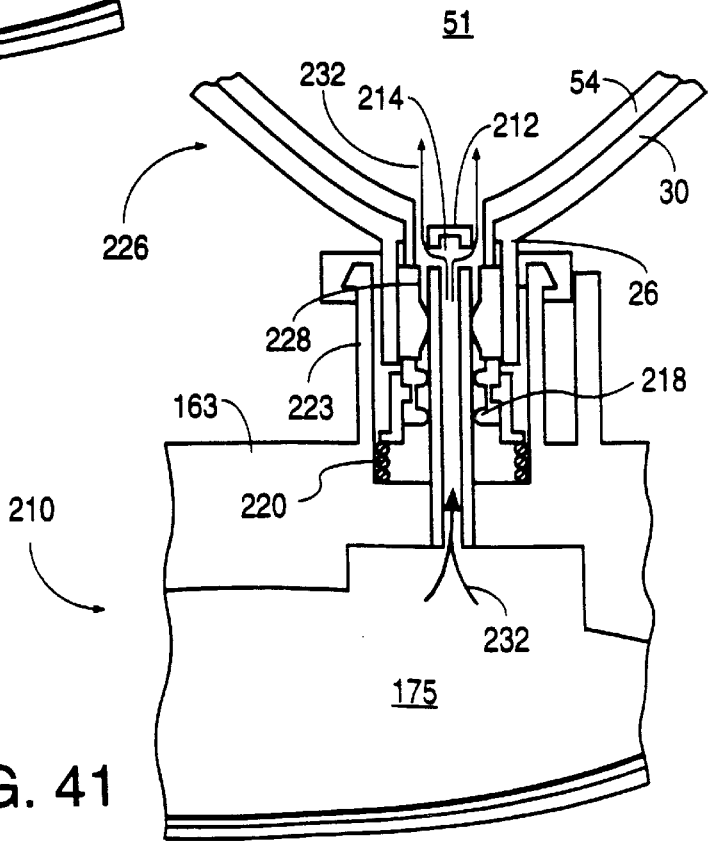
FIG. 41 is a close-up view of the print cartridge being refilled using the ink refill system of FIG. 39.

Instead of the coacting valves 24 and 156, previously described, a needle and septum may instead be used to allow refilling of the print cartridge with the ink in the ink refill system. FIGS. 39–41 illustrate this alternative embodiment.

A cross-section of an ink refill system 210 is shown in FIG. 39, which is similar to the cross-section illustrated in FIG. 28 but incorporating a hollow needle 212 rather than a sliding valve. Needle 212 has a hole 214 formed near its tip to allow ink from ink reservoir 175 to pass through needle 212 and out of hole 214 when the print cartridge is engaged with the ink refill system 210. In one embodiment, needle 212 is metal. In other embodiments, needle 212 may be formed of a plastic or any other suitable material.

An annular humidor 218 surrounds hole 214 and is urged upward by spring 220. Humidor 218 is preferably a relatively soft elastomeric material, such as rubber. Humidor 218 prevents ink leakage and air ingestion by hole 214. Alternatively, a simple rubber cap may be slid over the end of needle 212 to prevent ink leakage and air ingestion by hole 214.

An annular plastic retainer 222, affixed to sleeve 223, limits the upper travel of humidor 218.

FIG. 40 shows a close-up view of the needle portion of FIG. 39 and a close-up cross-sectional view of a print cartridge 226 which is identical to print cartridge 16, previously described, except that valve 24 (FIG. 5) is replaced with a rubber septum 228. Septum 228 is essentially cylindrical with a molded-in slit through its middle. Many different shapes of septum 228 may be used to achieve the desired fluid seal. Septum 228 is press-fit into cylindrical sleeve 26 of print cartridge 226, wherein the compression resulting from the insertion closes the molded-in slit. This creates a fluid seal of any ink within the negative pressure ink bag 51. In the preferred embodiment, septum 228 is tapered to improve needle insertion ease. The tip of needle 212 may be flat or otherwise blunted to additionally ease insertion, to reduce ink flow resistance, and to allow for a side hole 214.

FIG. 41 shows print cartridge 226 pressed onto the ink refill system 210 and supported as shown in FIG. 29. The downward movement of print cartridge 226 causes sleeve 26 to push humidor 218 downward while at the same time pushing needle 212 through septum 228. Hole 214 is now in fluid communication with ink bag 51, which allows ink in ink reservoir 175 to flow through hole 214 into ink bag 51. The flow of ink is illustrated by arrows 232. The engagement of sleeves 223 and 26 supports print cartridge 226 during the refill process, which is identical to that previously described.

When print cartridge 226 is lifted from the ink refill system 210, spring 220 pushes humidor 218 back to its original position, sealing hole 214.

In an alternative embodiment, the needle structure on ink refill system 210 is located on the print cartridge 226, and the septum 228 is located on the ink refill system 210.

In another embodiment, the needle assembly on ink reservoir 210 forms part of a syringe, or is located at the end of a tube connected to a flaccid ink bag, or forms part of any other suitable alternative ink recharge kit.

Conclusion

While particular embodiments of the prevent invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention. For example, ink refill system 150 or 210 may take any form as long as an ink reservoir in the ink refill system may be connected in fluid communication with the ink bag in print cartridge 16 or 226. Additionally, although a negative pressure ink bag is described, a negative pressure ink bag may not be necessary. The ink bag in print cartridge 16 or 226 will be refilled as long as the refill ink supply is at a pressure greater than the pressure in the ink bag. Such a pressure differential may be obtained by raising the external ink supply (e.g., ink refill system 150 or 210) above the print cartridge or providing the external ink supply with an internal positive pressure. The auxiliary reservoir may be a flaccid bag or a rigid vessel which may be vented or non-vented. Positive pressure may be achieved using a spring bag, a bellows, a syringe, a pressure regulator in series with the auxiliary ink reservoir and the print cartridge, or any other known technique.

What is claimed is:

1. A method for refilling a refillable print cartridge, said print cartridge having a print cartridge body containing a first ink reservoir having been initially filled with ink supplied through a first ink fill port in said print cartridge body, said first ink fill port being sealed with a first seal, said method comprising:

removably mounting said print cartridge on a carriage in a printer;

providing an external ink reservoir containing ink, separate from said print cartridge;

coupling said external ink reservoir to a recharge port on said body, said recharge port being separate from said first ink fill port and being sealed with a second seal which is in an opened state or a closed state, said closed state providing a fluid seal of said first ink reservoir, said opened state providing fluid communication between said external ink reservoir and said first ink reservoir when said external ink reservoir is connected to said recharge port, said second seal allowing no ambient air to enter said first ink reservoir when in fluid communication with said external ink reservoir;

operating said printer incorporating said print cartridge so as to print ink on a medium from a quantity of ink in said first ink reservoir;

recharging said first reservoir, when a supply of ink in said first ink reservoir is at least partially depleted, by:

a) creating a negative pressure, relative to atmospheric pressure, in said first ink reservoir after said supply of ink in said first ink reservoir has been at least partially depleted; and b) supplying ink at only predetermined times from said external ink reservoir to said first ink reservoir via a transfer tube connected between said external ink reservoir and said first ink reservoir.

2. The method of claim 1 wherein said supplying ink at only predetermined times comprises supplying ink after a printing operation has ceased.

3. The method of claim 1 wherein said supplying ink comprises controlling an amount of ink from said external ink reservoir through said transfer tube and into said first ink reservoir by a negative pressure regulator located within said print cartridge.

4. The method of claim 1 wherein said external ink reservoir contains ink at a positive pressure relative to atmospheric pressure.

5. The method of claim 1 wherein said external ink reservoir contains ink at atmospheric pressure.

6. The method of claim 1 wherein said external ink reservoir contains ink at a pressure which is greater than said negative pressure in said first ink reservoir.

7. The method of claim 1 further comprising filling said first ink reservoir with ink by supplying said ink through said first ink refill port in said print cartridge body.

8. The method of claim 7 wherein, after filling said first ink reservoir, said method further comprises inserting a stopper into said first ink fill port after said first ink reservoir is filled with said ink.

9. The method of claim 1 wherein said second seal is a septum which is selectively actuated to be in said opened state when a needle in fluid communication with said external ink reservoir is inserted through said septum, and said coupling comprises inserting said needle through said septum.

10. The method of claim 1 wherein said negative pressure within said first ink reservoir is such that said supplying ink comprises said negative pressure drawing ink from said external ink reservoir at only predetermined times once said external ink reservoir is in fluid communication with said first ink reservoir.

11. The method of claim 1 wherein said printer contains a plurality of print cartridges, each print cartridge being associated with a separate external ink reservoir containing a different color of ink.

12. The method of claim 11 wherein said different color of ink is selected from the group consisting of cyan, magenta, and yellow.

13. The method of claim 1 wherein said second seal comprises a slideable first valve and wherein said external ink reservoir includes a slideable second valve in fluid communication with ink within said external ink reservoir, and wherein said recharging said first ink reservoir comprises:

pushing said first valve and said second valve together a first amount to engage said first valve and said second valve to form an airtight fluid seal between said first ink reservoir and said external ink reservoir; and pushing said first valve and second valve together an additional amount to cause both said first valve and said second valve to slide into their respective reservoirs to cause said first valve and said second valve to be actuated from said closed state to said opened state to create a fluid path between said first reservoir and said external ink reservoir.

14. The method of claim 1 wherein said transfer tube is a flexible tube connected to said external ink reservoir, wherein said external ink reservoir is stationery.

15. The method of claim 1 further comprising the step of supplying ink to said external ink reservoir.

16. The method of claim 1 further comprising the step of supplying ink to said external ink reservoir once ink in said external ink reservoir has been at least partially depleted.

17. The method of claim 1 wherein said external ink reservoir comprises a replaceable ink cartridge, the method further comprising the step of replacing a first replaceable ink cartridge with another ink cartridge when said first replaceable ink cartridge is at least partially depleted of ink.

18. The method of claim 1 wherein said ink is a pigment-based ink.

19. The method of claim 1 wherein said ink is a dye-based ink.

* * * * *